US008092968B2

(12) United States Patent
Kikawa et al.

(10) Patent No.: US 8,092,968 B2
(45) Date of Patent: Jan. 10, 2012

(54) TONER, METHOD OF MANUFACTURING TONER, DEVELOPER, TWO-COMPONENT DEVELOPER, DEVELOPING DEVICE, AND IMAGE FORMING APPARATUS

(75) Inventors: Keiichi Kikawa, Osaka (JP); Ayae Nagaoka, Uji (JP); Katsuru Matsumoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 435 days.

(21) Appl. No.: 12/403,591

(22) Filed: Mar. 13, 2009

(65) Prior Publication Data

US 2009/0232557 A1 Sep. 17, 2009

(30) Foreign Application Priority Data

Mar. 14, 2008 (JP) ..... P2008-066791

(51) Int. Cl.
*G03G 9/08* (2006.01)

(52) U.S. Cl. ..... 430/110.1; 430/110.3; 430/110.4

(58) Field of Classification Search ..... 430/110.1, 430/110.3, 110.4
See application file for complete search history.

(56) References Cited

U.S. PATENT DOCUMENTS

| | | | | |
|---|---|---|---|---|
| 5,512,406 | A | 4/1996 | Takeda et al. | |
| 5,948,582 | A | 9/1999 | Nakamura et al. | |
| 6,060,202 | A * | 5/2000 | Ogawa et al. | 430/108.3 |
| 7,318,990 | B2 | 1/2008 | Makino et al. | |
| 2007/0218385 | A1 | 9/2007 | Kojima et al. | |
| 2008/0014514 | A1 | 1/2008 | Kamoto | |

FOREIGN PATENT DOCUMENTS

| | | | |
|---|---|---|---|
| CN | 101105652 | A | 1/2008 |
| JP | 6-059494 | A | 3/1994 |
| JP | 7-160037 | A | 6/1995 |
| JP | 2000-105488 | | 4/2000 |
| JP | 2004-271862 | | 9/2004 |
| JP | 2007-279715 | A | 10/2007 |

* cited by examiner

*Primary Examiner* — Hoa Le
(74) *Attorney, Agent, or Firm* — Nixon & Vanderhye, P.C.

(57) ABSTRACT

The toner includes a plurality of toner particles containing a binder resin and a colorant. In toner particles, according to measurement by a flow particle image analyzer, the content of small size particles having a circle-equivalent diameter of 0.5 to 2.0 μm is 5% by number or less based on the entire toner particles, the content of medium size particles having a circle-equivalent diameter of more than 2.0 μm and 4.0 μm or less is 20% by number or more and 30% by number or less based on the entire toner particles, and the content of large size particles having a circle-equivalent diameter of more than 4.0 μm and 6.0 μm or less is 50% by number or more and 70% by number or less based on the entire toner particles, and the shape factor of the toner particles SF1 is 130 or more and 140 or less.

12 Claims, 4 Drawing Sheets

TONER, METHOD OF MANUFACTURING TONER, DEVELOPER, TWO-COMPONENT DEVELOPER, DEVELOPING DEVICE, AND IMAGE FORMING APPARATUS

CROSS-REFERENCE TO RELATED APPLICATION

This application claims priority to Japanese Patent Application No. 2008-066791, which was filed on Mar. 14, 2008, the contents of which are incorporated herein by reference in its entirety.

BACKGROUND OF THE INVENTION

1. Field of the Invention

The present invention relates to a toner, a method of manufacturing the toner, a developer, a two-component developer, a developing device, and an image forming apparatus having the developing device.

2. Description of the Related Art

A toner is used to visualize a latent image in various image forming processes, and one known example thereof is an electrophotographic image forming process.

An image forming apparatus for forming images by using an electrophotographic system includes a photoreceptor, a charging section, an exposure section, a developing section, a transfer section, a fixing section and a cleaning section. The charging section charges the surface of the photoreceptor in a charging step. The exposure section irradiates a signal light to the surface of the photoreceptor in a charged state to form static latent images corresponding to image information. The developing section supplies a toner in a developer to the static latent images formed on the surface of the photoreceptor to develop static latent images thereby forming toner images in the development step. The transfer section transfers toner images formed on the surface of the photoreceptor to a recording medium in a transfer step. The fixing section fixes the transferred toner images to the recording medium in the fixing step. The cleaning section cleans the surface of the photoreceptor after transfer of the toner images in a cleaning step. The image forming apparatus develops static latent images to form images by using a one-component developer containing only a toner or a two-component developer containing a toner and a carrier as a developer. The toner used herein is resin particles formed by dispersing colorant, a release agent, etc. in a binder resin and granulating them.

Since the images forming apparatus using electrophotography can form images of good image quality at a high speed and inexpensively, they are utilized, for example, an copying machines, printers, and facsimile units and popularization of the image forming apparatus using electrophotography is remarkable in recent years. Correspondingly, a demand for the image forming apparatus has become severer. Among all, an importance is attached particularly to higher fineness and higher resolution of images formed by the image forming apparatus, stabilization of image quality, increase in the image forming speed, etc. For attaining them, investigation is indispensable both on the image forming process and the developer.

With respect to the higher fineness and higher resolution of the images, with a view point that reproduction of static latent images at high fidelity is important on the side of the developer, decrease in the size of toner particles is one of subjects to be solved, for which various proposals have been made.

However, in a case of manufacturing a toner with a small particle size of 4 to 6 μm in an average particle size while intending to obtain higher image quality, since toner particles having a particle size of 2 μm or less contained in a toner with an average particle size of 4 to 6 μm occupy the carrier surface even when the content in the entire toner particles is low to lowers the chargeability of the carrier, a supplied toner cannot be charged sufficiently to cause toner scattering upon continuous image output. Further, toner particles having a particle size of 2 μm or less results in various undesired effects in the improvement of the image quality, such as spent of the toner to the carrier surface, and filming of the toner to the photoreceptor and a developing sleeve.

For solving such problems, Japanese Patent Unexamined Publication JP-A 2005-196142 discloses a toner in which the ratio of particles having a circle-equivalent diameter of 0.6 to 2.0 μm as measured by a flow particle image analyzer is 0 to 5% by number, a weight average size is 4 to 7 μm, the ratio of particles of from 3.17 to 4.00 μm is 10 to 40% by number, the ratio of particles of 4.00 to 5.04 μm is from 20 to 40% by number, the ratio of coarse particles of 12.7 μm or more is 0 to 1.0% by weight, and the ratio (D4/D1) of the weight average size (D4) and the number average size (D1) is 1.04 to 1.30 measured by a Coulter counter method. In the toner disclosed in JP-A 2005-196142, the ratio of toner particles with a particle size of 2 μm or less that gives undesired effects in the improvement of the image quality is decreased to such an extent as not giving undesired effects in the improvement of the image quality. Such a toner can be manufactured by previous pulverization using a mechanical pulverizing system and subsequent pulverization by a counter air flow pulverizer.

However, in the toner disclosed In JP-A 2005-196142, it is not consider for the ratio of toner particles having a size larger than the range described above, that is, having a value of 2.0 μm or more as measured by the flow particle analyzer and a value based on the number of less than 3.17 μm as measured by the Coulter counter method. Since the toner of a small particle size with an average particle size of 4 to 6 μm intended for the higher image quality contains toner particles having a particle size in a range not considered in JP-A 2005-196142 and the toner particles in the range also concern generation of the toner scattering, it is difficult to sufficiently prevent fogging caused by toner scattering.

Further, in JP-A 2005-196142, while the ratio of the particles having a circle-equivalent diameter of 0.6 to 2.0 μm attributable to the toner scattering is defined as 0 to 5% by number, since the toner disclosed in JP-A 2005-196142 is a toner manufactured by a pulverization method and the shape of the toner particle is distorted, when a developer containing the toner disclosed in JP-A 2005-196142 is rotated idly in a developing apparatus, it may be a possibility that corners of toner particles are rounded off by collision of toner particles against each other to further generate particles having a circle-equivalent diameter of 0.6 to 2.0 μm.

SUMMARY OF THE INVENTION

The invention intends to provide a toner, capable of forming high quality images with no fogging and at high definition by suppressing occurrence of toner scattering sufficiently and suppressing occurrence of additional toner particles in a developing device; a manufacturing method of the toner; a developer; a two-component developer; a developing device; and an image forming apparatus having the developing device.

The invention provides a toner comprising a plurality of toner particles containing a binder resin and a colorant, wherein, according to measurement by a flow particle image analyzer, (a) a content of small size particles which are toner particles having a circle-equivalent diameter of 0.5 μm or more and 2.0 μm or less is 5% by number or less based on the entire toner particles, (b) a content of medium size particles which are toner particles having a circle-equivalent diameter larger than 2.0 μm and 4.0 μm or less is 20% by number or more and 30% by number or less in term of the number based on the total toner particles, (c) a content of large size particles which are toner particles having a circle-equivalent diameter above 4.0 μm and 6.0 μm or less is 50% by number or more and 70% by number or less based on the entire toner particles, and a shape factor SF1 of the toner particles is 130 or more and 140 or less.

According to the invention, the toner comprises a plurality of toner particles containing a binder resin and a colorant, wherein, according to measurement by a flow particle image analyzer, (a) a content of small size particles which are toner particles having a circle-equivalent diameter of 0.5 μm or more and 2.0 μm or less is 5% by number or less based on the entire toner particles, (b) a content of medium size particles which are toner particles having a circle-equivalent diameter larger than 2.0 μm and 4.0 μm or less is 20% by number or more and 30% by number or less in term of the number based on the total toner particles, (c) a content of large size particles which are toner particles having a circle-equivalent diameter above 4.0 μm and 6.0 μm or less is 50% by number or more and 70% by number or less based on the entire toner particles, and a shape factor SF1 of the entire toner particles is 130 or more and 140 or less.

Since toner particles having the circle-equivalent diameter described above can be measured all at once by measuring the circle-equivalent diameter of the toner particles by the flow particle image analyzer, measuring accuracy for the toner particles and the convenience can be improved.

Since the content of the small size particles is 5% by number or less based on the toner particles, the content of the medium size particles is 20% by number or more and 30% by number or less based on the entire toner particles, and the content of the large size particles is 50% by number or more and 70% by number or less based on the entire toner particles, toner scattering and filming to the photoreceptor caused by small size particles can be suppressed. Further, since the medium size particle intrudes into a gap between the large size particles, the bulk density of the entire toner can be increased and the distance between the toner particle can be made narrower compared with a case where the medium size particle does not intrude in the gap between the large size particles. Since intermolecular force exerts effectively by narrowing the gas between the toner particles, scattering materials to be charged, for example, carriers and toner particles before charging by a control blade can be suppressed. Since the intermolecular force is lower than the electrostatic force in view of relation of force for the charging amount at a developing level, the intermolecular force does not exert undesired effects on the behavior of the toner particles after charging. Specifically, in a case of using a one-component developer, the developer on the surface of a developing roller is not hindered from development to static latent images on the surface of the photoreceptor by the intermolecular force in the development step.

In a case where the content of the small size particles exceed 5% by number, toner scattering occurs and fogging is generated. In a case where the content of the medium size particles is less than 20% by number, since the number of medium size particles relative to the number of the large size particles decreases and gaps between the large size particles to which the medium size particles do not intrude increase compared with the case where the content of the medium size particles is 20% by number or more, the effect of improving the bulk density that enables the inter-molecular force to exert effectively by the increase of the bulk density for the entire toner cannot be obtained sufficiently, and the toner scattering cannot be suppressed. In a case where the content of the medium size particles exceeds 30% by number, since the number of the medium size particles that cannot be contained sufficiently in the gaps between the large size particles is increased compared with the case where the content of the medium size particles is 30% by number or less, the medium size particles may possibly cause toner scattering. In a case where the content of the large size particles is less than 50% by number, since the content of the medium size particles and the content of particles having a circle-equivalent diameter of 8.0 μm or more (hereinafter referred to as "coarse particle") increase, medium size particles that cannot be contained completely in the gap between the large size particles increase and the medium size particles may possibly cause toner scattering, compared with a case where the content of the large size particles is 50% by number or more. Further, the coarse particles result in difficulty in forming fine images. In a case where the content of the large size particles exceeds 70% by number, since the coefficient of variation is narrowed and the continuity of the particle size distribution between the large size particles and the medium size particles is worsened, the charging level is optimized to the large size particles, compared with the case where the content of the large size particles is 70% by number or less. As a result, since a difference is caused between the charging amount of the large size particles and the charging amount of the particles other than the large size particles, particles other than the large size particles tend to scatter and toner scattering cannot be suppressed. In addition, since the content of the medium size particles also decreases and gaps between the large size particles to which the medium size particles do not intrude increase, no sufficient effect of improving the bulk density can be obtained and toner scattering cannot be suppressed.

The shape factor SF1 shows the degree of roundness of particles. In a case where the value for SF1 is 100, the particle has a shape of a true sphere. As the value for SF1 increases, particles become amorphous particles. In a case where the shape factor SF1 is less than 130, since the shape of a particle approaches to that of a true sphere and residual transfer toner remaining on the surface of an image bearing member without transfer after the transfer step is less caught by a cleaning blade, cleaning failure occurs to possibly worsen the image quality, compared with a case where the shape factor SF1 is 130 or more. In a case where the shape factor SF1 exceeds 140, the shape of the toner particles becomes more amorphous and corners are formed to toner particles, compared with a case where the shape factor SF1 is 140 or less, toner particles friction to each other during idle rotation of the developer in developing tank, to additionally generate toner particles by cracking of the toner particles, and toner scattering tends to occur by the additional toner particles.

When the shape factor SF1 is 130 or more and 140 or less, since the toner particle can be made to a shape not properly having corners and rounded properly, cleaning property can be made satisfactory. Further, generation of toner particles caused by friction between each of the toners and cracking of the toner particles can be suppressed to suppress toner scattering.

Accordingly, by defining the content of the toner particles having a particle size that causes toner scattering and defining the shape factor SF1 of the entire toner particles, cleaning property can be improved and additional generation of toner particles in the developing tank can be suppressed to obtain a toner capable of further suppressing the toner scattering than the existent toner. By forming images using such a toner, high quality toner images at high definition with no fogging can be formed stably. Further, since the bulk density for the entire toner can be increased compared with a case where the content of the small size particles, medium size particles, and large size particles are not within the range described above, the volume necessary for containing the toner can be decreased and the size of the toner container can be decreased.

Further, in the invention, it is preferable that a ratio A/B for a number A of the medium size particles and a number B of the large size particles satisfies the following expression (1):

$$0.30 \leqq A/B \leqq 0.60 \quad (1)$$

According to the invention, a ratio A/B for a number A of the medium size particles and a number B for the large size particles satisfies the expression (1). In a case where the ratio A/B is less than 0.30, since the number of the medium size particles relative to the number of the large size particles decreases and the gaps between large size particles to which the medium size particles do not intrude increase, compared with the case where the ratio A/B is 0.30 or more, an effect of improving the bulk density cannot be obtained sufficiently and the toner scattering may not possibly be suppressed. In a case where the ratio A/B exceeds 0.60, since particles not contained in the gaps between the large size particles and rendered free (hereinafter referred to as "free particles") increase compared with the case under the ratio A/B is 0.60 or less, toner scattering tends to occur. Since the toner scattering can be suppressed further when the ratio A/B for the number A of the medium size particles and the number B of the large size particles satisfies the expression (1), high quality images at high definition with no fogging can be formed stably. Further, since the volume necessary for containing the toner can be decreased further, the size of the toner container can be decreased more.

Further, in the invention, it is preferable that a ratio r/R between a peak value r for the number-based particle size of the medium size particles which is a particle size of toner particles at a highest content among the medium size particles, and a peak value R for the number-based particle size of the large size particles which is a particle size of the toner particles at a highest content among the large size particles satisfies the following expression (2):

$$0.50 < r/R < 0.70 \quad (2)$$

According to the invention, a ratio r/R between a peak value r for the number-based particle size of the medium size particles which is a particle size of toner particles at a highest content among the medium size particles, and a peak value R for the number-based particle size of the large size particles which is a size particle of the toner particles at a highest content among the large particles size satisfies the expression (2). In a case where the ratio r/R is 0.50 or less, since a difference between the peak value r for the number-based particle size of the medium size particles and a peak value R for the number-based particle size of the large size particles increases, and the volume of the medium size particles relative to the volume of gaps between the large size particles decreases, compared with the case where the ratio r/R is more than 0.50, no sufficient effect for the improvement of the bulk density can be obtained and the toner cannot be charged efficiently. In this case, the medium size particles tend to scatter more than the large size particles and tend to become not charged free particles. Since the free particles are not developed, selective development that the large size particles are developed but the medium size particles are not developed may possibly occur to lower the image quality. In a case where the ratio r/R is 0.70 or more, since the difference between the peak value r for the number-based particle size of the medium size particles and the peak value R for the number-based particle size of the large size particles decreases and the medium size particles having the particle size that cannot intrude into the gaps between the large size particles increase compared with the case where the ratio r/R is less than 0.70, the free particles increase tending to generate toner scattering. Since toner scattering can be suppressed further when the ratio r/R satisfies the expression (2), high quality images at high definition with no fogging can be formed further stably. Further, since the volume necessary for containing the toner can be decreased further, the size of the toner container can be decreased more.

Further, the invention provides a method of manufacturing the toner described above, comprising mixing a first group of toner particles having a number average particle size of 2.0 or more and 4.0 μm or less and a second group of toner particles having a number average particle size of 4.0 μm or more and 6.0 μm or less.

According to the invention, the method of manufacturing the toner comprises mixing of a first group of toners having a number average particle size of 2.0 or more and 4.0 μm or less and a second group of toner particles having a number average particle size of 4.0 μm or more and 6.0 μm or less. By mixing the first group of toner particles and the second group of toner particles, it is possible to obtain the toner of the invention having the effect of improving the bulk density and having an appropriate value for the ratio r/R between the peak value r for the number-based particle size of the medium size particles and the peak value R for the number-based particle size of the large size particles.

Further, in the invention, it is preferable that a coefficient of variation of the first group of toner particles is 16 or more and 25 or less.

According to the invention, a coefficient of variation of the first group of toner particles is 16 or more and 25 or less. In a case where the coefficient of variation of the first group of the toner particles exceeds 25, since the content of the small size particles increases compared with the case where the coefficient of variation of the first group of toner particles is 25 or less, toner scattering tends to occur. In a case where the coefficient of variation of the first group of toner particles is less than 16, since it is difficult to manufacture the toner compared with the case where the coefficient of variation of the first group of the toner particles is 16 or more, this increase the manufacturing cost. Since toner scattering caused by the small size particles can be suppressed by defining the coefficient of variation of the first group of toner particles to 16 or more and 25 or less, high quality images at high definition with no fogging can be formed stably. Further, the cost for manufacturing the toner can be suppressed.

Further, in the invention, it is preferable that a coefficient of variation of the second group of toner particles is 19 or more and 30 or less.

According to the invention, the coefficient of variation of the second group of toner particles is 19 or more and 30 or less. In a case where the coefficient of variation of the second group of toner particles is more than 30, since the content of the particles having a circle-equivalent diameter of 0.5 or more and 2.0 μm or less relative to the entire toner particles increases, compared with a case where the coefficient of variation of the second group of particles is 30 or less, toner scattering tends to occur by the toner particles having the circle-equivalent diameter described above. Further, since the content of the coarse particles relative to the entire toner particles increases, it is difficult to obtain images of high definition. In a case where the coefficient of variation of the second group of toner particles is less than 19, since discontinuity with the first group of the toner particles to be mixed increases in the particle size distribution and the volume of the medium size particles relative to the volume of the gaps between the large size particles decreases, compared with a case where the coefficient of variation of the second group of toner particles is 19 or more, no sufficient effect for the improvement of the bulk density can be obtained and the number of free particles increases tending to cause selective development. Since generation of coarse particles can be suppressed and toner scattering can be suppressed when the coefficient of variation of the second group of toner particles is 19 or more and 30 or less, high quality images at high definition with no fogging can be formed more stably.

Further, the Invention provides a developer comprising the toner described above.

According to the invention, the developer comprises the toner described above. This enables formation of high quality images at high definition without fogging caused by toner scattering and image deterioration due to a cleaning failure, and the developer to be provided with other properties stable with long-term use, thus resulting in the developer which is capable of maintaining a favorable developing property.

Further, the invention provides a two-component developer comprising the toner described above and a carrier.

According to the invention, the developer is a two-component developer comprising the toner described above and a carrier. The toner of the invention has sufficient effect for the improvement of bulk density, thereby suppressing toner spattering and providing a two-component developer having favorable cleaning property. The use of such a two-component developer allows to suppress fogging caused by toner spattering and image determination due to a cleaning failure, and to form high quality images at high definition stably.

Further, the invention provides a developing device for developing a latent image formed on an image bearing member by using the developer or two-component developer and thereby forming a toner image.

According to the invention, a latent image is developed with the developer described above, so that a toner image having high definition and high resolution can be stably formed on an image bearing member.

Consequently, it is possible to stably form a high quality image at high definition with no fogging.

Further, the invention provides an image forming apparatus comprising:

an image bearing member on which a latent image is formed;

a latent image forming section for forming a latent image on the image bearing member; and the developing device described above.

According to the invention, an image forming apparatus comprises an image bearing member on which a latent image is formed; a latent image forming section for forming a latent image on the image bearing member; and the developing device described above being capable of forming on the image bearing member, a toner image having high definition and high resolution. By forming images through such an image forming apparatus, it is possible to stably form an image with high quality images at high definition.

BRIEF DESCRIPTION OF DRAWINGS

Other and further objects, features, and advantages of the invention will be more explicit from the following detailed description taken with reference to the drawings wherein.

DETAILED DESCRIPTION

Figure 1:
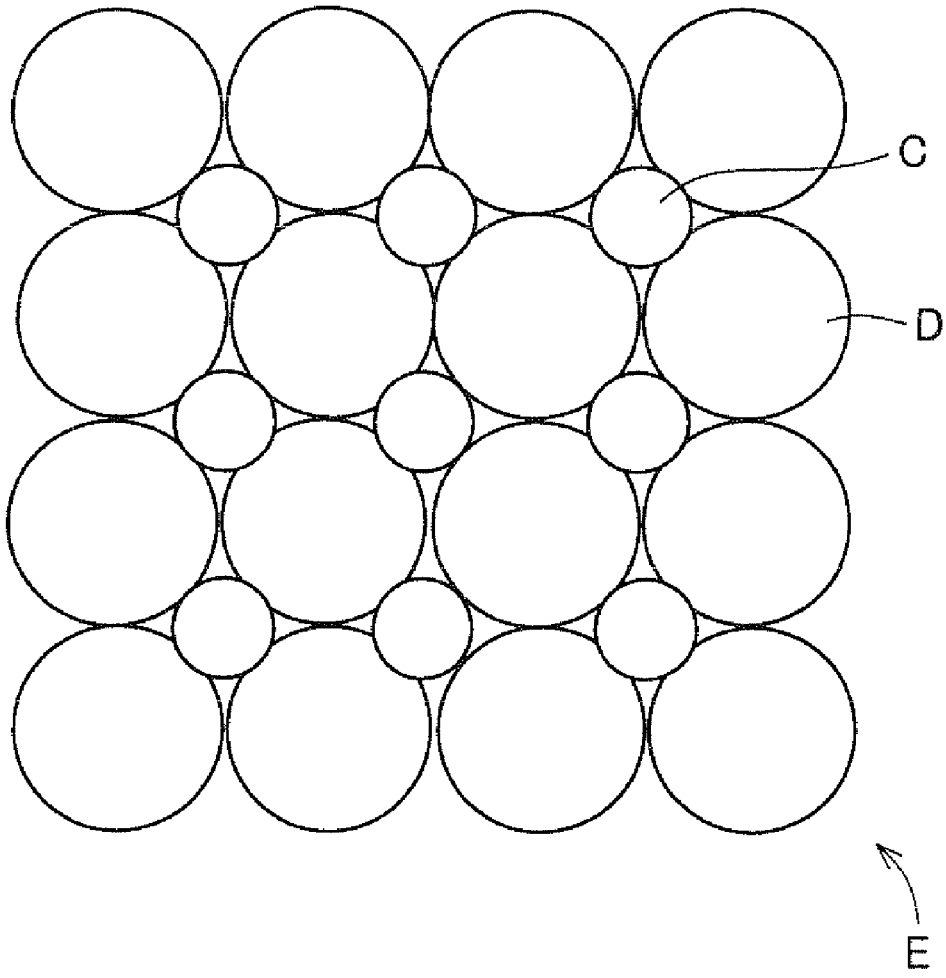
FIG. 1 is a view schematically showing a filled state of a toner E of an embodiment.

Now referring to the drawings, preferred embodiments of the invention are described below.

1. Toner

A toner as an embodiment of the invention contains plurality of toner particles containing a binder resin and a colorant, wherein, according to measurement by flow particle image analyzer, (a) the content of small size particles which are toner particles having a circle-equivalent diameter of 0.5 μm or more and 2.0 μm or less is 5% by number or less based on the entire toner particles, (b) the content of medium size particles which are toner particles having a circle-equivalent diameter of more than 2.0 μm and 4.0 μm or less is 20% by number or more and 30% by number or less based on the entire toner particles, (c) the content of large size particles which are toner particles having a circle-equivalent diameter of more than 4.0 μm and 6.0 μm or less is 50% by number or more and 70% by number or less based on the entire toner particles, and the shape factor SF1 of the toner particles is 130 or more and 140 or less.

[Binder Resin]

The binder resin used in the invention is not particularly limited, and examples of the binder resin include: a polyester; an acrylic resin; polyurethane; and an epoxy resin.

For the polyester resin, a heretofore known polyester resin can be used, and examples thereof include polycondensation of polybasic acids and polyvalent alcohols. For the polybasic acids, those known as monomers of the polyester resin may be used, and examples thereof include aromatic carboxylic acids such as terephthalic acid, isophthalic acid, phthalic anhydride, trimellitic anhydride, pyromellitic acid, and naphthalene dicarboxylic acid; and aliphatic carboxylic acids such as maleic anhydride, fumaric acid, succinic acid, alkenyl succinic anhydride, adipic acid and a methyl-esterified compound of polybasic acid. The polybasic acids may be used each alone, or two or more thereof may be used in combination.

For the polyvalent alcohol, those commonly known as monomers of the polyester can also be used and examples thereof include: aliphatic polyvalent alcohols such as ethylene glycol, propylene glycol, butenediol, hexanediol, neopentyl glycol, and glycerin; alicyclic polyvalent alcohols such as cyclohexanediol, cyclohexanedimethanol, and hydrogenated bisphenol A; and aromatic diols such as ethylene oxide adduct of bisphenol A and propylene oxide adduct of bisphenol A. The polyalcohols may be used each alone, or two or more thereof may be used in combination.

The polybasic acid and the polyvalent alcohol can undergo polycondensation reaction in an ordinary manner, that is, for example, the polybasic acid and the polyvalent alcohol are brought into contact with each other in the presence or absence of the organic solvent and in the presence of the polycondensation catalyst. The polycondensation reaction ends when an acid number, a softening temperature, etc. of the polyester to be produced reach predetermined values. The polyester is thus obtained. When the methyl-esterified compound of the polybasic acid is used as part of the polybasic acid, demethanol polycondensation reaction is caused. In the polycondensation reaction, a compounding ratio, a reaction rate, etc. of the polybasic acid and the polyvalent alcohol are appropriately modified, thereby being capable of, for example, adjusting a content of a carboxyl end group in the polyester and thus allowing for denaturation of the polyester. The denatured polyester can be obtained also by simply introducing a carboxyl group to a main chain of the polyester with use of trimellitic anhydride as polybasic acid.

For acrylic resin, heretofore known substances may be used, and acid group-containing acrylic resin can be preferably used among them. The acid group-containing acrylic resin can be produced, for example, by polymerization of acrylic resin monomers or polymerization of an acrylic resin monomer and a vinylic monomer with concurrent use of an acidic group- or hydrophilic group-containing a acrylic resin monomer and/or acidic group- or hydrophilic group-containing a vinylic monomer.

For acrylic resin monomer, heretofore known substances may be used including, for example, acrylic acid which may have a substituent, methacrylic acid which may have a substituent, acrylic acid ester which may have a substituent, and methacrylic acid ester which may have a substituent. The acrylic resin monomers may be used each alone, or two or more of them may be used in combination.

The vinylic resin monomer is not particularly limited, and may be a heretofore known substance including, for example, styrene, α-methylstyrene, vinyl bromide, vinyl chloride, vinyl acetate, acrylonitrile, and methacrylonitrile. The vinylic monomers may be used each alone, or two or more of them may be used in combination. The polymerization is effected by use of a commonly-used radical initiator in accordance with a solution polymerization method, a suspension polymerization method, an emulsification polymerization method, or the like method.

For the polyurethane, a heretofore known polyurethane can be used, and there is preferably used a polyurethane containing an acidic group or a basic group. The acidic group- or basic group-containing polyurethane can be produced according to a known method. For example, an acidic group- or basic group-containing diol, polyol and polyisocyanate may be addition-polymerized. As the acid-group or basic group-containing diol, there can be exemplified dimethylolpropionic acid and N-methyldiethanolamine. As the polyol, there can be exemplified polyetherpolyol such as polyethylene glycol, as well as polyesterpolyol, acrylpolyol and polybutadienepolyol. As the polyisocyanate, there can be exemplified tolylene diisocyanate, hexamethylene diisocyanate and isophorone diisocyanate. These components may be used each alone or two or more of them may be used in combination.

For the epoxy resin, heretofore known epoxy resins can be used. Among them, an acidic group- or basic group-containing epoxy resin can be preferably used. The acidic group- or basic group-containing epoxy resin can be prepared by, for example, adding or addition-polymerizing an adipic acid and a polyhydric carboxylic acid such as trimellitic anhydride or an amine such as dibutylamine or ethylenediamine with the epoxy resin that serves as a base.

Among those binder resins, polyester is preferred. Polyester is preferable as binder resin for color toner in order to provide obtained toner particles with its excellent transparency as well as good powder flowability, low-temperature fixing property, and secondary color reproducibility. Further, polyester may be grafted with acrylic resin. Further, polyester may be grafted with acrylic resin.

[Colorant]

As the colorant, it is possible to use an organic dye, an organic pigment, an inorganic dye, and an inorganic pigment, which are customarily used in the electrophotographic field.

Examples of black colorant include: carbon black, copper oxide, manganese dioxide, aniline black, activated carbon, non-magnetic ferrite, magnetic ferrite, and magnetite.

Examples of yellow colorant include: chrome yellow, zinc yellow, cadmium yellow, yellow iron oxide, mineral fast yellow, nickel titanium yellow, navel yellow, naphthol yellow S, hanza yellow G, hanza yellow 10G, benzidine yellow G, benzidine yellow GR, quinoline yellow lake, permanent yellow NCG, tartrazine lake, C.I. pigment yellow 12, C.I. pigment yellow 13, C.I. pigment yellow 14, C.I. pigment yellow 15, C.I. pigment yellow 17, C.I. pigment yellow 74, C.I. pigment yellow 93, C.I. pigment yellow 94, C.I. pigment yellow 138, C.I. pigment yellow 180 and C.I. pigment yellow 185.

Examples of orange colorant include: red chrome yellow, molybdenum orange, permanent orange GTR, pyrazolone orange, vulcan orange, indanthrene brilliant orange RK, benzidine orange C, indanthrene brilliant orange GK, C.I. pigment orange 31, and C.I. pigment orange 43.

Examples of red colorant include: red iron oxide, cadmium red, red lead oxide, mercury sulfide, cadmium, permanent red 4R, lysol red, pyrazolone red, watching red, calcium salt, lake red C, lake red D, brilliant carmine 6B, eosin lake, rhodamine lake B, alizarin lake, brilliant carmine 3B, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, and C.I. pigment red 222.

Examples of purple colorant include: manganese purple, fast violet B, and methyl violet lake.

Examples of blue colorant include: Prussian blue, cobalt blue, alkali blue lake, Victoria blue lake, phthalocyanine blue, non-metal phthalocyanine blue, phthalocyanine blue-partial chlorination product, fast sky blue, indanthrene blue BC, C.I. pigment blue 15, C.I. pigment blue 15:2, C.I. pigment blue 15:3, C.I. pigment blue 16, and C.I. pigment blue 60.

Examples of green colorant include: chromium green, chromium oxide, pigment green B, malachite green lake, final yellow green G, and C.I. pigment green 7.

Examples of white colorant include: those compounds such as zinc white, titanium oxide, antimony white, and zinc sulfide.

The colorants may be used each alone, or two or more of the colorants of different colors may be used in combination. Further, two or more of the colorants with the same color may be used in combination. A usage ratio of the binder resin and the colorant is not particularly limited, and ordinarily, a usage of the colorant is preferably, 0.1 part by weight to 20 parts by weight, and more preferably 0.2 part by weight to 10 parts by weight, based on 100 parts of the binder resin.

[Release Agent]

The toners of the embodiment contains other toner components such as a release agent and a charge control agent, if necessary. When the toner contains a release agent, it is possible to suppress occurrence of fixing offset. When the toner contains a charge control agent, it is possible to enhance the chargeability of the toner.

As the release agent, it is possible to use ingredients which are customarily used in the relevant field, including, for example, petroleum wax such as paraffin wax and derivatives thereof, and microcrystalline wax and derivatives thereof; hydrocarbon-based synthetic wax such as Fischer-Tropsch wax and derivatives thereof, polyolefin wax and derivatives thereof, low-molecular-weight polypropylene wax and derivatives thereof, and polyolefinic polymer wax (low-molecular-weight polyethylene wax, etc.) and derivatives thereof; vegetable wax such as carnauba wax and derivatives thereof, rice wax and derivatives thereof, candelilla wax and derivatives thereof, and haze wax; animal wax such as bees wax and spermaceti wax; fat and oil-based synthetic wax such as fatty acid amides and phenolic fatty acid esters; long-chain carboxylic acids and derivatives thereof; long-chain alcohols and derivatives thereof; silicone polymers; and higher fatty acids. Note that examples of the derivatives include oxides, block copolymers of a vinylic monomer and wax, and graft-modified derivatives of a vinylic monomer and wax. A usage of the wax may be appropriately selected from a wide range without particularly limitation, and preferably 0.2 part by weight to 20 parts by weight based on 100 parts by weight of the binder resin.

[Charge Control Agent]

The usable charge control agent includes a charge control agent for controlling positive charges and a charge control agent for controlling negative charges.

Examples of the charge control agent for controlling positive charges include a basic dye, quaternary ammonium salt, quaternary phosphonium salt, aminopyrine, a pyrimidine compound, a polynuclear polyamino compound, aminosilane, a nigrosine dye, a derivative thereof, a triphenylmethane derivative, guanidine salt, and amidine salt.

Examples of the charge control agent for controlling negative charges include oil-soluble dyes such as oil black and spiron black, a metal-containing azo compound, an azo complex dye, metal salt naphthenate, salicylic acid, metal complex and metal salt (the metal includes chrome, zinc, and zirconium) of a salicylic acid derivative, a boron compound, a fatty acid soap, long-chain alkylcarboxylic acid salt, and a resin acid soap.

The charge control agents may be used each alone, and optionally two or more thereof may be used in combination. A usage of the compatible charge control agent is not particularly limited and may be appropriately selected in broad area, but preferably 0.5 part by weight to 3 parts by weight based on 100 parts by weight of the binder resin.

[Flow Particle Image Analyzer]

As described above, the toner of this embodiment is defined by the circle-equivalent diameter of toner particles measured by the flow particle image analyzer. Since the toner particles having the circle-equivalent diameter described above can be measured all at once by measuring the circle-equivalent diameter of the toner particles by the flow particle image analyzer, the measuring accuracy of the toner particles and the convenience can be improved.

Then, a method of measuring a toner by using a flow particle image analyzer is to be described below.

Measurement of toner particles by the flow particle image analyzer can be carried out, for example, by using a flow particle image analyzer model FPIA-2000 manufactured by Sysmex Corporation.

Measurement is carried out by adding several droplets of a noionic surfactant (preferably, CONTAMINON N; manufactured by Wako Pure Chemical Industries, Ltd.) to 10 mL of water containing particles by the number of 20 or less within the range of measurement (for example, circle-equivalent diameter of 0.50 μm or more and less than 159.21 μm) in $10^{-3}$ $cm^3$ of water as a result of removing fine dusts through a filter, further adding 5 mg of a specimen to be measured, conducting a dispersing treatment for one min by a supersonic disperser UH-50 manufactured by STM Corporation under the conditions at 20 kHz and 50 W/10 $cm^3$, conducting further dispersing treatment for 5 min in total, and measuring the particle size distribution of particles having a circle-equivalent diameter of 0.50 μm or more and less than 159.21 μm by using a liquid dispersion of the specimen at a particle concentration of the specimen to be measured of 4,000 to 8,000 particles/$10^{-3}$ $cm^3$ (particles to be measured in the range of the circle-equivalent diameter as an object).

The liquid dispersion of the specimen is passed through a flow channel (diverging along the direction of flow) of a flat and planar transparent flow cell (about 200 μm thickness). For forming an optical channel that passes crossing the thickness of the flow cell, a stroboscope and a CCD camera are mounted to the flow cell such that they are situated on the sides opposite to each other. During flow of the liquid dispersion of the specimen, a strobe light is irradiated at 1/30 sec interval for obtaining images of particles flowing in the flow cell and, as a result, individual particles are photographed as two-dimensional images having a parallel constant range to the flow cell. Based on the area of two-dimensional images of respective particles, a diameter of a circle having an identical area is calculated as a circle-equivalent diameter.

The circle-equivalent diameter of particles by the number of 1200 or more can be measured for about one min and the ratio of particles having the number based on the circle-equivalent distribution and the defined circle-equivalent diameter (% by number) can be measured. The result (frequency % and accumulation %) can be obtained by dividing the range for 0.06 to 400 μm into 226 channels (divided into 30 channels relative to 1 octave) as shown in Table 1. In an actual measurement, particles are measured in a range of the circle-equivalent diameter of 0.50 μm or more and less than 159.21 μm.

[Particle Size Distribution and Shape Factor SF1]

FIG. 1 is a view schematically showing a filled state of a toner E of the embodiment. As described above, since the content of the small size particles is 5% by number or less based on the toner particles, the content of the medium size particles C is 20% by number or more and 30% by number or less based on the entire toner particles and the content of the large size particles D is 50% by number or more and 70% by number or less based on the entire toner particles, toner scattering and toner filming to a photoreceptor caused by small size particles can be suppressed. Further, as shown in FIG. 1, since the medium size particles C intrude into the gaps between the large size particles D, the bulk density of the entire toner can be increased and the distance between the toner particles can be narrowed compared with the case where the medium size particles C do not intrude into the gap between the large size particles D. Since intermolecular force exerts effectively by narrowing the gap between the toner particles, scattering materials to be charged, for example, carriers and toner particles before charging by a control blade can be suppressed. Since the intermolecular force is lower than the electrostatic force in view of relation of force for the charging amount at a developing level, the intermolecular force does not exert undesired effects on the behavior of the toner particles after charging. Specifically, in a case of using a one-component developer, the developer on the surface of a developing roller is not hindered from development to static latent images on the surface of the photoreceptor by the intermolecular force in the development step.

In a case where the content of the small size particles exceed 5% by number, toner scattering occurs and fogging is generated. In a case where the content of the medium size particles C is less than 20% by number, since the number of medium size particles C relative to the number of the large size particles D decreases and gaps between the large size particles D to which the medium size particles do not intrude increase compared with the case where the content of the medium size particles C is 20% by number or more, the effect of improving the bulk density that enables the inter-molecular force to exert effectively by the increase of the bulk density for the entire toner cannot be obtained sufficiently, and the toner scattering cannot be suppressed. In a case where the content of the medium size particles C exceeds 30% by number, since the number of the medium size particles C that cannot be contained sufficiently in the gaps between the large size particles D is increased compared with the case where the content of the medium size particles is 30% by number or less, the medium size particles C may possibly cause toner scattering. In a case where the content of the large size particles D is less than 50% by number, since the content of the medium size particles C and the content of particles having a circle-equivalent diameter of 8.0 μm or more (hereinafter referred to as "coarse particle") increase, medium size particles C that cannot be contained completely in the gap between the large size particles D increase and the medium size particles C may possibly cause toner scattering, compared with a case where the content of the large size particles D is 50% by number or more. Further, the coarse particles result in difficulty in forming fine images. In a case where the content of the large size particles D exceeds 70% by number, since the coefficient of variation is narrowed and the continuity of the particle size distribution between the large size particles D and the medium size particles C is worsened, the charging level is optimized to the large size particles D, compared with the case where the content of the large size particles D is 70% by number or less. As a result, since a difference is caused between the charging amount of the large size particles D and the charging amount of the particles other than the large size particles D, particles other than the large size particles D tend to scatter and toner scattering cannot be suppressed. In addition, since the content of the medium size particles C also decreases and gaps between the large size particles D to which the medium size particles C do not intrude increase, no sufficient effect of improving the bulk density can be obtained and toner scattering cannot be suppressed.

The shape factor SF1 shows the degree of roundness of particles. In a case where the value for SF1 is 100, the particle has a shape of a true sphere. As the value for SF1 increases, particles become amorphous particles. In a case where the shape factor SF1 is less than 130, since the shape of a particle approaches to that of a true sphere and residual transfer toner remaining on the surface of an image bearing member without transfer after the transfer step is less caught by a cleaning blade, compared with a case where the shape factor SF1 is 130 or more, cleaning failure occurs to possibly worsen the image quality. In a case where the shape factor SF exceeds 140, the shape of the toner particles becomes more amorphous and corners are formed to toner particles, compared with a case where the shape factor SF1 is 140 or less, toner particles friction to each other during idle rotation of the developer in a developing tank, to additionally generate toner particles by cracking of the toner particles, and toner scattering tends to occur by the additional toner particles. Since the shape factor SF1 of the toner particle is 130 or more and 140 or less, the toner particles can be made to a shape not properly having corners and rounded properly, so that cleaning property can be made satisfactory. Further, generation of toner particles caused by friction between each of the toners and cracking of the toner particles can be suppressed to suppress toner scattering.

Accordingly, by defining the content of the toner particles having a particle size that causes toner scattering and defining the shape factor SF1 of the entire toner particles, cleaning property can be improved and additional generation of toner particles in the developing tank can be suppressed to obtain a toner capable of suppressing the toner scattering. By forming images using such a toner, high quality toner images at high definition with no fogging can be formed stably. Further, since the bulk density for the entire toner can be increased compared with a case where the content of the small size particles, medium size particles C, and large size particles D are not within the range described above, the volume necessary for containing the toner can be decreased and the size of the toner container can be decreased.

The shape factor SF1 is a value measured according to the following method.

2.0 g of toner particles, 1 mL of sodium alkyl ether sulfate ester, and 50 mL of pure water were added to a 100 mL beaker and stirred sufficiently, to prepare a liquid dispersion of toner particles. The liquid dispersion of the toner particles is treated by a supersonic homogenizer (manufactured by Nippon Seiki Co., Ltd.) at a power of 50 μA for 5 min, and the toner particles are further dispersed in the liquid dispersion of the toner particles. After standing still the liquid dispersion of the toner particles for 6 hr and removing supernatants, 50 mL of a liquid dispersion of toner particles is added and stirred by a magnetic stirrer for 5 min. Then, filtration is carried out under suction by using a membrane filter (aperture: 1 μm). Cleaned products on the membrane filter are vacuum-dried in a silica gel-containing desiccator for about one night.

A metal film (Au film, 0.5 μm thickness) is formed by sputtering vapor deposition on the surface of toner particles, which are cleaned for the surface as described above. Metal film-coated particles are extracted therefrom by the number of about 500 at random and photographed by a scanning electron microscope (trade name: S-570, manufactured by Hitachi Ltd.) under an acceleration voltage of 5 kV and at a magnification factor of 1000×. The electron microscopic photographic data are subjected to image analysis by an image analysis software (trade name: A-ZO-KUN; manufactured by Asahi Kasei Engineering Corporation). The particle analysis parameters of the image analysis software "A-ZO-KUN" includes small graph removing area: 100 pixels, shrinkage separation: number of cycles 1; small graph: 1; number of cycles: 10, noise elimination filter: none, shading: none, result display unit: μm. Based on the maximum length MXLNG, peripheral length PERI, and graph area AREA for the toner particles obtained as described above, a shape coefficient SF1 is obtained according to the following formula (A):

$$SF1=\{(MXLNG)2/AREA\}\times(100\pi/4) \quad (A)$$

[Ratio of Number]

In this embodiment, the ratio A/B between the number A for the medium size particles and the number B for the large size particles preferably satisfy the following expression (1):

$$0.30 \leqq A/B \leqq 0.60 \quad (1)$$

In a case where the ratio A/B is less than 0.30, since the number of the medium size particles relative to the number of the large size particles decreases and the gaps between large size particles D to which the medium size particles do not intrude increases, compared with the case where the ratio A/B is 0.30 or more, an effect of improving the bulk density cannot be obtained sufficiently and the toner particles may not possibly be suppressed. In a case where the ratio A/B exceeds 0.60, since particles not contained in the gaps between the large size particles D and rendered free (hereinafter referred to as "free particles") increase, toner scattering tends to occur, as compared with a case where the ratio A/B is 0.60 or less. Since the toner scattering can be suppressed further when the ratio A/B for the number A of the medium size particles C and the number B of the large size particles D satisfies the expression (1), high quality images at high definition with no fogging can be formed stably. Further, since the volume necessary for containing the toner can be decreased further, the size of the toner container can be decreased more.

[Peak Value of Number-Based Particle Size]

Further, according to this embodiment, it is preferred that the ratio r/R between the peak value r for the number-based particle size of the medium size particles C which is the particle size of toner particles at the highest content among the medium size particles C, and a peak value R for the number-based particle size of the large size particles D which is the particle size of the toner particles at the highest content among the large size particles D satisfies the following expression (2):

$$0.50 < r/R < 0.70 \quad (2)$$

Figure 2:
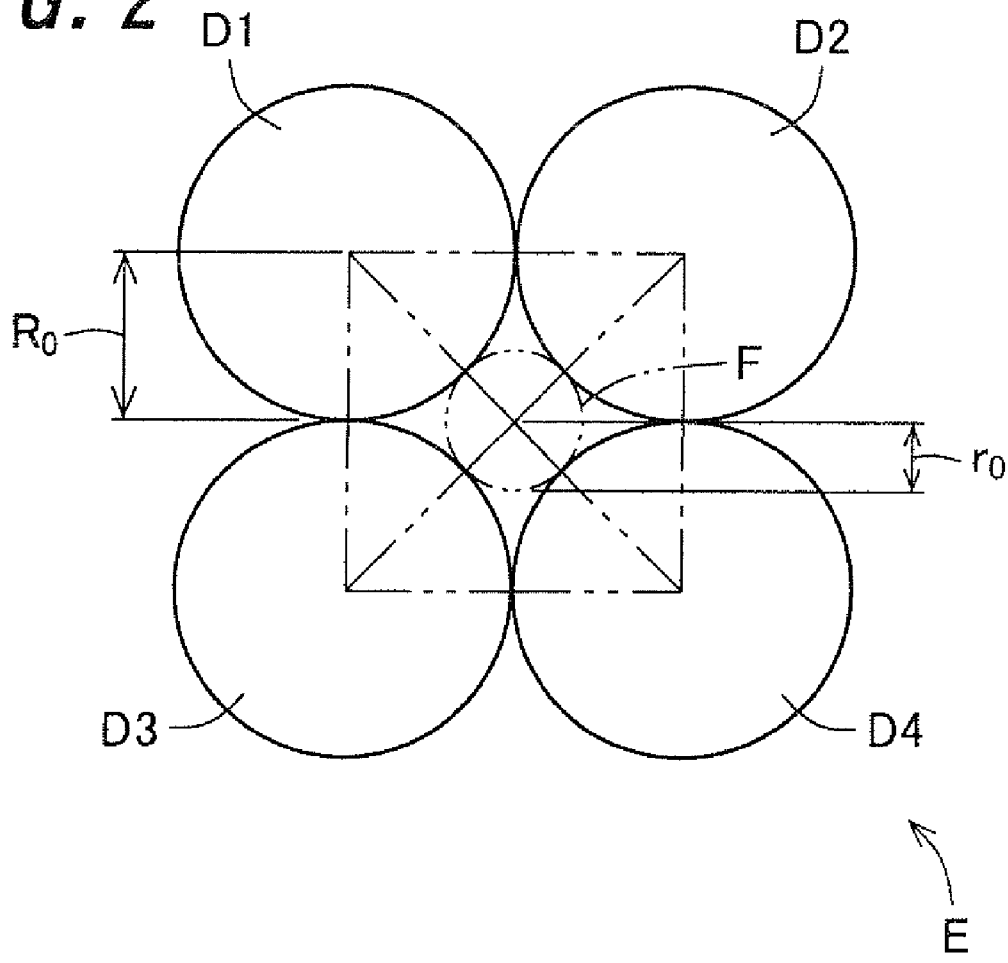
FIG. 2 is a view schematically showing the filled state of a toner E where the medium size particles C shown in FIG. 1 are not filled.

FIG. 2 is a view schematically showing the filled state of a toner E where the medium size particles C shown in FIG. 1 are not filled. As shown in FIG. 2, assuming the radius of the large size particles D1 to D4 as $R_0$ (μm), the length for the diagonal line connecting the centers of the large size particle D1 and the large size particles D4 is $2R_0 \times \sqrt{2}$. Further, also the length of the diagonal line connecting the centers of the large size particle D2 and the large size particle D3 is $2R_0 \times \sqrt{2}$. Diameter $2r_0$ of a circle F filling a gap surrounded by the large size particles D1, D2, D3, D4 is $2(\sqrt{2}-1)R_0$ [μm] and $r_0=(\sqrt{2}-1)R_0$ [μm]. $r_0/R_0=(\sqrt{2}-1)=0.41$. Since the medium size particles C intrude into the gap between eight large size particles D, a medium size particle C of a particle size larger than that of the circle F intrudes into the gap between the large size particles D.

In a case where the ratio r/R is 0.50 or less, since a difference between the peak value r for the number-based particle size of the medium size particles C and a peak value R for the number-based particle size of the large size particles D increases and the volume of the medium size particles C relative to the volume of gaps between the large size particles D decreases compared with the case where the ratio r/R is more than 0.50, no sufficient effect for the improvement of the bulk density can be obtained and the toner cannot be charged efficiently. In this case, the medium size particles C tend to scatter more than the large size particles D and tend to become not charged free particles. Since the free particles are not developed, selective development that the large size particles D are developed but the medium size particles C are not developed may possibly occur to lower the image quality. In a case where the ration r/R is 0.70 or more, since the difference between the peak value r for the number-based particle size of the medium size particles C and the peak value R for the number-based particle size of the large size particles D decreases and the medium size particles C having the particle size that cannot intrude into the gaps between the large size particles D increase, compared with the case where the ratio r/R is less than 0.70, free particles increase tending to generate toner scattering. Since toner scattering can be suppressed further when the ratio r/R satisfies the expression (2), high quality images at high definition with no fogging can be formed further stably. Further, the volume necessary for containing the toner can be decreased further, the size of the toner container can be decreased more.

[External Additive]

For the above-described toner, it is preferable to add an external additive having a function, for example, of improving the powder fluidity, improving the triboelectricity, heat resistance, improving the long time storability, improving the cleaning property, and controlling the surface abrasion property of the photoreceptor. The external additive includes, for example, fine silica powder, fine titanium oxide, and fine alumina powder. The external additives may be used each alone, or two or more of them may be used in combination. The addition amount of the external additives is preferably 2 parts by weight or less based on 100 parts by weight of the toner particles while considering the charging amount necessary for the toner, the effect on the friction of the photoreceptor, and the environmental property of the toner by the addition of the external additives.

In the particle size distribution of the toner after addition of the external additive in this embodiment, the external additive is preferably added externally such that the content of the small size particles which are toner particles having the circle-equivalent diameter of 0.5 μm or more and 2.0 μm or less is 7% by number or less based on the entire toner particles, the content of the medium size particles, which are toner particles having the circle-equivalent diameter of more than 2.0 μm and 4.0 μm or less is 19% by number or more and 29% by number or less based on the entire toner particles, the content of the large size particles, which are toner particles having the circle-equivalent diameter of more than 4.0 μm and 6.0 μm or less is 49% by number or more and 69% by number or less based on the entire toner particles in the measurement according to the flow particle image analyzer. By externally adding the external additive such that the particle size distribution of the toner after addition of the external additive, high quality image at high definition with no fogging can be formed stably without deteriorating the effect of the toner of the embodiment described above with no addition of the external additive, for example, that toner scattering can be suppressed.

2. Method of Manufacturing Toner

The method of manufacturing the toner of this embodiment is not particularly limited and can be obtained by a known manufacturing method.

[Melt-Kneading Pulverization Method]

The toner of this embodiment can be manufactured, for example, by a melt-kneading pulverization method. According to the melt kneading pulverization method, the toner can be manufactured by dry mixing a binder resin, a colorant, a release agent, a charge controller, and other additives each in a predetermined amount, melt kneading the obtained mixture, cooling to solidify the obtained melt-kneaded product, and mechanically pulverizing the obtained solidification product.

Examples of a mixer used for the dry-mixing process include Henschel type mixing apparatuses such as HEN- SCHEL MIXER (product name) manufactured by Mitsui Mining Co., Ltd., SUPERMIXER (product name) manufactured by Kawata MFG Co., Ltd., and MECHANOMILL (product name) manufactured by Okada Seiko Co., Ltd. ANGMILL (product name) manufactured by Hosokawa Micron Corporation, HYBRIDIZATION SYSTEM (product name) manufactured by Nara Machinery Co., Ltd., and COSMOSYSTEM (product name) manufactured by Kawasaki Heavy Industries, Ltd.

In the kneading process, the mixture is agitated under application of heat at a temperature which is higher than or equal to the melting temperature of the binder resin (normally ca. 80 to 200° C., preferably 100 to 150° C.). As the kneading machine for use, typical ones such for example as a twin-screw extruder, a three-roll mill, and a laboplast mill may be used. The specific examples of typical kneading machines include single- or twin-screw extruders such as TEM-100B (product name) manufactured by Toshiba Machine Co., Ltd. and PCM-65/87 (product name) manufactured by Ikegai, Ltd., and kneaders of open roll type such as KNEADEX (product name) manufactured by Mitsui Mining Co., Ltd. Among them, kneaders of open roll type are preferable for use.

Examples of the pulverizer for use in pulverization of the solid product obtained by cooling the melt-kneaded product include a cutter mill, a feather mill and a jet mill. For example, the solid product is roughly pulverized by a cutter mill, and is thereafter pulverized by a jet mill. In this way, it is possible to obtain a toner having a desired circle-equivalent diameter.

[High Pressure Homogenizer Method]

Further, the toner of the invention can be manufactured, for example, by coarsely pulverizing the solidification product of melt-kneaded product, forming an aqueous slurry from the obtained coarsely pulverized product, treating the obtained aqueous slurry into fine particles by a high pressure homogenizer, and heating the obtained fine toner particles in an aqueous medium thereby coagulating and melting them.

The solidification product of melt-kneaded products are coarsely pulverized by using, for example, a jet mill or a hand mill. A coarse powder of the melt-kneaded product having a particle size of about 100 μm to 3 mm is obtained by coarse pulverization. The coarse powder of the melt-kneaded product is dispersed in water to prepare an aqueous slurry containing the coarse powder of the melt-kneaded product. When the coarse powder of the melt-kneaded product is dispersed in water, an aqueous slurry in which the coarse powder is uniformly dispersed is obtained, for example, by dissolving an appropriate amount of a dispersant such as sodium dodecyl benzene sulfonate in water. By treating the aqueous slurry containing the coarse powder of the melt-kneaded product by a high pressure homogenizer, the coarse powder in the aqueous slurry is finely particulated to obtain an aqueous slurry containing fine toner particles having a volume average particles size of about 0.4 to 1.0 μm. The toner containing toner particles having desired particle size distribution and shape factor are obtained by heating the aqueous slurry containing the fine toner particles, coagulating fine toner particles, and melting to bond the fine toner particles to each other. Upon coagulation of the fine toner particles, coagulation can be preceded efficiently by adding a coagulant such as a monovalent salt, a bivalent salt, or a trivalent salt in an appropriate amount. The particle size distribution and the shape factor can be controlled each to a desired value by properly selecting the heating temperature and the heating time for the aqueous slurry containing the fine toner particles. The heating temperature is properly selected within a temperature range of a softening point or higher of the binder resin and lower than the heat decomposition temperature of the binder resin. In a case where the heating time is identical, the circle-equivalent diameter of the obtained toner particles usually increases more as the heating temperature is higher.

As the high-pressure homogenizer, commercially available ones are known. The examples thereof include high-pressure homogenizers of chamber type such as MICROFLUIDIZER (product name) manufactured by Microfluidics International Corporation, NANOMIZER (product name) manufactured by NANOMIZER Inc., and ULTIMIZER (product name) manufactured by Sugino Machine Limited, and HIGH-PRESSURE HOMOGENIZER (product name) manufactured by Rannie Corporation, HIGH-PRESSURE HOMOGENIZER (product name) manufactured by Sanmaru Machinery Co., LTD., HIGH-PRESSURE HOMOGENIZER (product name) manufactured by Izumi Food Machinery Co., LTD., and NANO3000 (product name) manufactured by Beryu Co., Ltd.

The whole or part of the toner may be subjected to spheronization treatment. As the means for conducting spheronization, there are an impact-force spheronizing apparatus and a hot-air spheronizing apparatus. As the impact-force spheronizing apparatus, commercially available ones, for example, FACULTY (product name) manufactured by Hosokawa Micron Corporation and HYBRIDIZATION SYSTEM (product name) manufactured by Nara Machinery Co., Ltd. may be used. As the hot-air spheronizing apparatus, commercially available ones, for example, a surface modification machine: METEORAINBOW (product name) manufactured by Nippon Pneumatic Mfg. Co., Ltd. may be used. By being subjected to spheronization treatment, it is possible to make the shape factor SF1 to be optimized.

In the method of manufacturing the toner according to this embodiment, it is preferred to mix a first group of toners with the number average particle size of 2.0 or more and 4.0 μm or less and a second group of toner particles with the number average particle size of 4.0 μm or more and 6.0 μm or less. By mixing the first group of toner particles and the second group of toner particles, it is possible to obtain the toner of the invention having the effect of improving the bulk density and having an appropriate value for ratio r/R between the peak value r for the number-based particle size of the medium size particles and the peak value R for the number-based particle size of the large size particles.

The first group of toner particles and the second group of toner particles are manufactured, for example, by the melt-kneading pulverization method or the high pressure homogenizer method, respectively, and the toner is prepared by mixing the first group of the toner particles and the second group of the toner particles.

Examples of a mixer used for the dry-mixing process include Henschel type mixing apparatuses such as a Henschel mixer (product name: FM MIXER) manufactured by Mitsui Mining Co., Ltd., SUPERMIXER (product name) manufactured by Kawata MEG Co. Ltd., and MECHANOMILL (product name) manufactured by Okada Seiko Co., Ltd., ANGMILL (product name) manufactured by Hosokawa Micron Corporation, HYBRIDIZATION SYSTEM (product name) manufactured by Nara Machinery Co., Ltd., and COSMOSYSTEM (product name) manufactured by Kawasaki Heavy Industries, Ltd.

In the embodiment, it is preferable that the coefficient of variation of the first group of toner particles is 16 or more and 25 or less. In a case where the coefficient of variation of the first group of the toner particles exceeds 25, since the content of the small size particles increases compared with the case where the coefficient of variation of the first group of toner particles is 25 or less, toner scattering tends to occur. In a case where the coefficient of variation of the first group of toner particles is less than 16, since it is difficult to manufacture the toner compared with the case where the coefficient of variation of the first group of the toner particles is 16 or more, this increase the manufacturing cost. Since toner scattering caused by the small size particles can be suppressed by defining the coefficient of variation of the first group of toner particles to 16 or more and 25 or less, high quality images at high definition with no fogging can be formed stably. Further, the cost for manufacturing the toner can be suppressed.

In the embodiment, it is preferable that the coefficient of variation of the second group of toner particles is 19 or more and 30 or less. In a case where the coefficient of variation of the second group of toner particles is more than 30, since the content of the particles having a circle-equivalent diameter of 0.5 or more and 2.0 μm or less relative to the entire toner particles increases, compared with a case where the coefficient of variation of the second group of particles is 30 or less, toner scattering tends to occur by the toner particles having the circle-equivalent diameter described above. Further, since the content of the coarse particles relative to the entire toner particles increases, it is difficult to obtain images of high definition. In a case where the coefficient of variation of the second group of toner particles is less than 19, since discontinuity with the first group of the toner particles to be mixed increases in the particle size distribution and the volume of the medium size particles relative to the volume of the gaps between the large size particles decreases, compared with a case where the coefficient of variation of the second group of toner particles is 19 or more, no sufficient effect for the improvement of the bulk density can be obtained and the number of free particles increases tending to cause selective development. Since generation of coarse particles can be suppressed and toner scattering can be suppressed when the coefficient of variation of the second group of toner particles is 19 or more and 30 or less, high quality images at high definition with no fogging can be formed more stably.

3. Developer

The toner of the invention manufactured as above can be used as a one-component developer without change, and can also be mixed with a carrier to be used in form of a two-component developer.

It is preferable that the developer comprises the toner of the invention. This enables to form high quality images at high definition without fogging caused by toner scattering and image deterioration due to a cleaning failure and the developer to be provided with other properties stable with long-term use, thus resulting in the developer which is capable of maintaining a favorable developing property.

It is preferable that the developer is a two-component developer comprising the toner of the invention and a carrier. The toner of the invention has sufficient effect for the improvement of the bulk density, thereby suppressing toner spattering and providing the two-component developer having favorable cleaning property. The use of such a two-component developer allows to suppress fogging caused by toner spattering and image determination due to a cleaning failure, and to form high quality images at high definition stably.

[Carrier]

For the carrier, magnetic particles can be used. Specific examples of the magnetic particles include metals such as iron, ferrite, and magnetite; and alloys composed of the metals just cited and metals such as aluminum or lead. Among these examples, ferrite is preferred.

Further, the carrier can be a resin-coated carrier in which the magnetic particles are coated with resin, or a dispersed-in-resin carrier in which the magnetic particles are dispersed in resin. The resin used for coating the magnetic particles includes, but is not particularly limited to, for example, an olefin-based resin, a styrene-based resin, a styrene-acrylic resin, a silicone-based resin, an ester-based resin, and a fluorine-containing polymer-based resin. The resin used for the dispersed-in-resin carrier includes, but is not particularly limited either to, for example, a styrene-acrylic resin, a polyester resin, a fluorine-based resin, and a phenol resin.

A shape of the carrier is preferably spherical or flat. Further, the particle size of the carrier is not particularly limited, and in consideration of enhancement in image quality, it is preferably 10 μm to 100 μm and more preferably 20 μm or more and 50 μm or less. The resistivity of the carrier is preferably $10^8 \Omega \cdot cm$ or more and more preferably $10^{12} \Omega \cdot cm$ or more. The carrier's resistivity is obtained as follows. The carrier is put in a vessel having a cross-sectional area of 0.50 $cm^2$ and crammed in the vessel by tapping and then, a load of 1 $kg/cm^2$ is imposed on the carrier in the vessel while a voltage is applied between the load and a bottom electrode to generate an electric field of 1,000 V/cm there. In the situation just described, a current value is read from which the carrier's resistivity is derived. The low resistivity will cause charge injection into a carrier when a bias voltage is applied to the developing sleeve, and this makes the carrier particles become more likely to adhere to a photoreceptor. In addition, this induces breakdown of the bias voltage more frequently.

Magnetization intensity (maximum magnetization) of the carrier is preferably 10 emu/g or more and 60 emu/g or less, and more preferably 15 emu/g or more and 40 emu/g or less. The magnetization intensity depends on magnetic flux density of the developing roller. Under a condition that the developing roller has normal magnetic flux density, the magnetization intensity less than 10 emu/g will lead to a failure to exercise magnetic binding force, which may cause the carrier to spatter. When the magnetization intensity exceeds 60 emu/g, it becomes difficult to keep a noncontact state with an image bearing member in a noncontact development where brush of the carrier is too high, and in a contact development, sweeping patterns may appear more frequently in a toner image.

A use ratio between the toner and the carrier contained in the two-component developer is not particularly limited and may be appropriately selected according to kinds of the toner and the carrier. To take the case of the resin-coated carrier (having density of 5 $g/cm^2$ to 8 $g/cm^2$) as an example, it is preferable to use the toner in such an amount that the content of the toner in the developer is 2% by weight or more and 30% by weight or less, more preferably 2% by weight or more and 20% by weight or less, of a total amount of the developer. Further, in the two-component developer, the coverage of the toner over the carrier is preferably 40% or more and 80% or less.

4. Image Forming Apparatus

Figure 3:
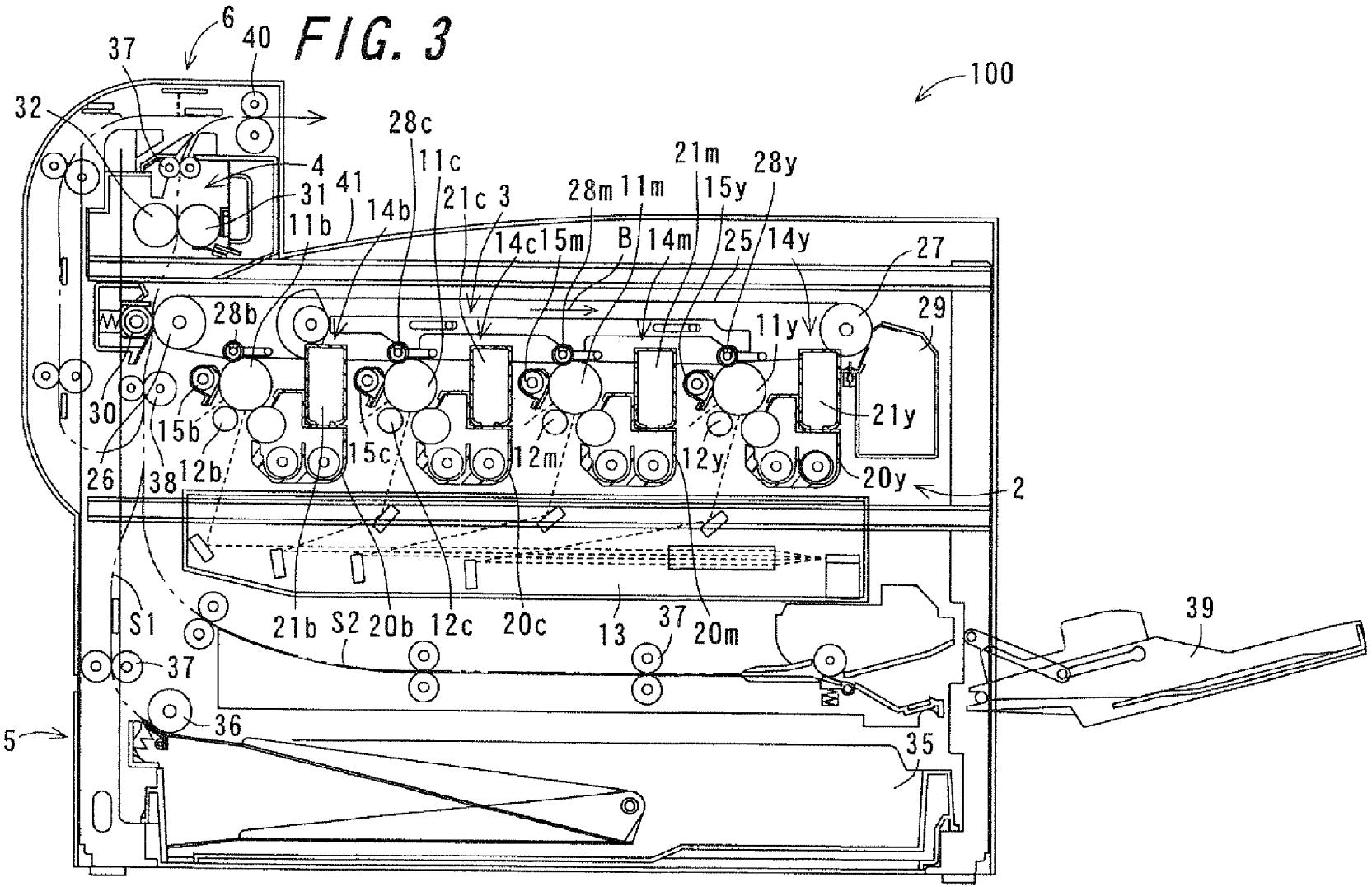
FIG. 3 is a sectional view schematically showing a configuration of an image forming apparatus according to another embodiment of the invention.

FIG. 3 is a schematic view showing a configuration of an image forming apparatus 100 according to another embodiment of the invention. The image forming apparatus 100 is a multifunctional peripheral having a copier function, a printer function, and a facsimile function together, and according to image information being conveyed to the image forming apparatus 100, a full-color or monochrome image is formed on a recording medium. That is, the image forming apparatus 100 has three types of print mode, i.e., a copier mode, a printer mode and a FAX mode, and the print mode is selected by a control unit (not shown) in accordance with, for example, the operation input from an operation portion (not shown) and reception of the printing job from external equipment such as a personal computer, a mobile device, an information recording storage medium, and a memory device.

The image forming apparatus 100 includes a photoreceptor drum 11 serving as an image bearing member, an image forming section 2, a transfer section 3, a fixing section 4, a recording medium feeding section 5, and a discharging section 6. In accordance with image information of respective colors of black (b), cyan (c), magenta (m), and yellow (y) which are contained in color image information, there are provided respectively four sets of the components constituting the image forming section 2 and some parts of the components contained in the transfer section 3. The four sets of respective components provided for the respective colors are distinguished herein by giving alphabets indicating the respective colors to the end of the reference numerals, and in the case where the sets are collectively referred to, only the reference numerals are shown.

The image forming section 2 includes a charging section 12, an exposure unit 13, a developing device 14, and a cleaning unit 15. The charging section 12 and the exposure unit 13 each function as a latent image forming section. The charging section 12, the developing device 14, and the cleaning unit 15 are disposed around the photoreceptor drum 11 in the order just stated. The charging section 12 is disposed vertically below the developing device 14 and the cleaning unit 15.

The photoreceptor drum 11 is a roller-shaped member which is disposed so as to rotatable about an axis thereof by a rotation-driving section (not shown) and on which surface part an electrostatic latent image is formed. The rotation-driving section of the photoreceptor drum 11 is controlled by a control unit composed of a central processing unit (CPU). The photoreceptor drum 11 includes a conductive substrate (not shown) and a photosensitive layer (not shown) formed on a surface of the conductive substrate. The conductive substrate may be formed into various shapes such as a cylindrical shape, a circular columnar shape, and a thin film sheet shape. Among these shapes, the cylindrical shape is preferred. The conductive substrate is formed of a conductive material.

As the conductive material, those customarily used in the relevant field can be used including, for example, metals such as aluminum, copper, brass, zinc, nickel, stainless steel, chromium, molybdenum, vanadium, indium, titanium, gold, and platinum; alloys formed of two or more of the metals; a conductive film in which a conductive layer containing one or two or more of aluminum, aluminum alloy, tin oxide, gold, indium oxide, etc. is formed on a film-like substrate such as a synthetic resin film, a metal film, and paper; and a resin composition containing at least conductive particles and/or conductive polymers. As the film-like substrate used for the conductive film, a synthetic resin film is preferred and a polyester film is particularly preferred. Further, as the method of forming the conductive layer in the conductive film, vapor deposition, coating, etc. are preferred.

The photosensitive layer is formed, for example, by stacking a charge generating layer containing a charge generating substance, and a charge transporting layer containing a charge transporting substance. In this case, an undercoat layer is preferably formed between the conductive substrate and the charge generating layer or the charge transporting layer. When the undercoat layer is provided, the flaws and irregularities present on the surface of the conductive substrate are covered, leading to advantages such that the photosensitive layer has a smooth surface, that chargeability of the photosensitive layer can be prevented from degrading during repetitive use, and that the charging property of the photosensitive layer can be enhanced under a low temperature circumstance and/or a low humidity circumstance. Further, the photosensitive layer may be a laminated photoreceptor having a highly-durable three-layer structure in which a photoreceptor surface-protecting layer is provided on the top layer.

The charge generating layer contains as a main ingredient a charge generating substance that generates charge under irradiation of light, and optionally contains known binder resin, plasticizer, sensitizer, etc. As the charge generating substance, materials used customarily in the relevant field can be used including, for example, perylene pigments such as perylene imide and perylenic acid anhydride; polycyclic quinone pigments such as quinacridone and anthraquinone; phthalocyanine pigments such as metal and non-metal phthalocyanines, and halogenated non-metal phthalocyanines; squalium dyes; azulenium dyes; thiapylirium dyes; and azo pigments having carbazole skeleton, styryistilbene skeleton, triphenylamine skeleton, dibenzothiophene skeleton, oxadiazole skeleton, fluorenone skeleton, bis-stilbene skeleton, distyryloxadiazole skeleton, or di-styryl carbazole skeleton. Among those charge generating substances, non-metal phthalocyanine pigments, oxotitanyl phthalocyanine pigments, bisazo pigments containing fluorene rings and/or fluorenone rings, bisazo pigments containing aromatic amines, and trisazo pigments have high charge generating ability and are suitable for forming a highly-sensitive photosensitive layer. The charge generating substances may be used each alone, or two or more thereof may be used in combination. The content of the charge generating substance is not particularly limited, and preferably 5 parts by weight or more and 500 parts by weight or less, more preferably 10 parts by weight or more and 200 parts by weight or less based on 100 parts by weight of the binder resin in the charge generating layer. Also as the binder resin for charge generating layer, materials used customarily in the relevant field can be used including, for example, melamine resin, epoxy resin, silicone resin, polyurethane, acrylic resin, vinyl chloride-vinyl acetate copolymer resin, polycarbonate, phenoxy resin, polyvinyl butyral, polyallylate, polyamide, and polyester. The binder resins may be used each alone or, optionally, two or more thereof may be used in combination.

The charge generating layer can be formed by dissolving or dispersing an appropriate amount of a charge generating substance, a binder resin and, optionally, a plasticizer, a sensitizer, etc. respectively in an appropriate organic solvent in which the ingredients described above are dissolvable or dispersible, to thereby prepare a coating solution for charge generating layer, and then applying the coating solution for charge generating layer to the surface of the conductive substrate, followed by drying the coated surface. The thickness of the charge generating layer obtained in this way is not particularly limited, and preferably is 0.05 μm or more and 5 μm or less, more preferably 0.1 μm or more and 2.5 μm or less.

The charge transporting layer stacked over the charge generating layer contains as essential ingredients a charge transporting substance having an ability of receiving and transporting the charge generated from the charge generating substance, and a binder resin for charge transporting layer, and optionally contains known antioxidant, plasticizer, sensitizer, lubricant, etc. As the charge transporting substance, materials used customarily in the relevant field can be used including, for example: electron donating materials such as poly-N-vinyl carbazole, a derivative thereof, poly-γ-carbazolyl ethyl glutamate, a derivative thereof, a pyrene-formaldehyde condensation product, a derivative thereof, polyvinylpyrene, polyvinyl phenanthrene, an oxazole derivative, an oxadiazole derivative, an imidazole derivative, 9-(p-diethylaminostyryl)anthracene, 1,1-bis(4-dibenzylaminophenyl) propane, styryianthracene, styrylpyrazoline, a pyrazoline derivative, phenyl hydrazones, a hydrazone derivative, a triphenylamine compound, a tetraphenyldiamine compound, a triphenylmethane compound, a stilbene compound, and an azine compound having 3-methyl-2-benzothiazoline ring; and electron accepting materials such as a fluorenone derivative, a dibenzothiophene derivative, an indenothiophene derivative, a phenanthrenequinone derivative, an indenopyridine derivative, a thioquisantone derivative, a benzo[c]cinnoline derivative, a phenazine oxide derivative, tetracyanoethylene, tetracyanoquinodimethane, bromanil, chloranil, and benzoquinone. The charge transporting substances may be used each alone, or two or more thereof may be used in combination. The content of the charge transporting substance is not particularly limited, and preferably is 10 parts by weight or more and 300 parts by weight or less, more preferably 30 parts by weight or more and 150 parts by weight or less, based on 100 parts by weight of the binder resin in the charge transporting substance.

As the binder resin for charge transporting layer, it is possible to use materials which are used customarily in the relevant field and capable of uniformly dispersing the charge transporting substance, including, for example, polycarbonate, polyallylate, polyvinylbutyral, polyamide, polyester, polyketone, an epoxy resin, polyurethane, polyvinylketone, polystyrene, polyacrylamide, a phenolic resin, a phenoxy resin, a polysulfone resin, and a copolymer resin thereof. Among those materials, in view of the film forming property, and the wear resistance, an electrical property etc. of the obtained charge transporting layer, it is preferable to use, for example, polycarbonate which contains bisphenol Z as the monomer ingredient (hereinafter referred to as "bisphenol Z polycarbonate"), and a mixture of bisphenol Z polycarbonate and other polycarbonate. The binder resins may be used each alone, or two or more thereof may be used in combination.

The charge transporting layer preferably contains an antioxidant in addition to the charge transporting substance and the binder resin for charge transporting layer. Also for the antioxidant, materials used customarily in the relevant field can be used including, for example, Vitamin E, hydroquinone, hindered amine, hindered phenol, paraphenylene diamine, arylalkane, and derivatives thereof, an organic sulfur compound, and an organic phosphorus compound. The antioxidants may be used each alone, or two or more thereof may be used in combination. The content of the antioxidant is not particularly limited, and is 0.01% by weight or more and 10% by weight or less, preferably 0.05% by weight or more and 5% by weight or less, of the total amount of the ingredients constituting the charge transporting layer.

The charge transporting layer can be formed by dissolving or dispersing an appropriate amount of a charge transporting substance, a binder resin and, optionally, an antioxidant, a plasticizer, a sensitizer, etc. respectively in an appropriate organic solvent which is capable of dissolving or dispersing the ingredients described above, to thereby prepare a coating solution for charge transporting layer, and applying the coating solution for charge transporting layer to the surface of a charge generating layer, followed by drying the coated surface. The thickness of the charge transporting layer obtained in this way is not particularly limited, and preferably is 10 μm or more and 50 μm or less, more preferably 15 μm or more and 40 μm or less.

It is also possible to form a photosensitive layer in which a charge generating substance and a charge transporting substance are present in one layer. In this case, the kinds and contents of the charge generating substance and the charge transporting substance, the kind of the binder resin, and other additives may be the same as those in the case of forming separately the charge generating layer and the charge transporting layer.

In the embodiment, there is used a photoreceptor drum which has an organic photosensitive layer as described above containing the charge generating substance and the charge transporting substance. It is, however, also possible to use, instead of the above photoreceptor drum, a photoreceptor drum which has an inorganic photosensitive layer containing silicon or the like.

The charging section 12 faces the photoreceptor drum 11 and is disposed away from the surface of the photoreceptor drum 11 when viewed in a longitudinal direction of the photoreceptor drum 11. The charging section 12 charges the surface of the photoreceptor drum 11 so that the surface of the photoreceptor drum 11 has predetermined polarity and potential. As the charging section 12, it is possible to use a charging brush type charging device, a charger type charging device, a pin array type charging device, an ion-generating device, etc. Although the charging section 12 is disposed away from the surface of the photoreceptor drum 11 in the embodiment, the configuration is not limited thereto. For example, a charging roller may be used as the charging section 12, and the charging roller may be disposed in pressure-contact with the photoreceptor drum 12. It is also possible to use a contact-charging type charger such as a charging brush or a magnetic brush.

The exposure unit 13 is disposed so that light beams corresponding to each color information emitted from the exposure unit 13 pass between the charging section 12 and the developing device 14 and reach the surface of the photoreceptor drum 11. In the exposure unit 13, the image information is converted into light beams corresponding to each color information of black, cyan, magenta, and yellow, and the surface of the photoreceptor drum 11 which has been evenly charged by the charging section 12, is exposed to the light beams corresponding to each color information to thereby form electrostatic latent images on the surfaces of the photoreceptor drums 11. As the exposure unit 13, it is possible to use a laser scanning unit having a laser-emitting portion and a plurality of reflecting mirrors. The other usable examples of the exposure unit 13 may include an LED array and a unit in which a liquid-crystal shutter and a light source are appropriately combined with each other.

The cleaning unit 15 removes the toner which remains on the surface of the photoreceptor drum 11 after the toner image formed on the surface of the photoreceptor drum 11 by the developing device 14 has been transferred to the recording medium, and thus cleans the surface of the photoreceptor drum 11. In the cleaning unit 15, a platy member is used such as a cleaning blade. In the image forming apparatus of the invention, an organic photoreceptor drum is mainly used as the photoreceptor drum 11. A surface of the organic photoreceptor drum contains a resin component as a main ingredient and therefore tends to be degraded by chemical action of ozone which is generated by corona discharging of a charging device. The degraded surface part is, however, worn away by abrasion through the cleaning unit 15 and thus removed reliably, though gradually. Accordingly, the problem of the surface degradation caused by the ozone, etc. is actually solved, and the potential of charge given in the charging operation can be thus maintained stably for a long period of time. Although the cleaning unit 15 is provided in the embodiment, no limitation is imposed on the configuration and the cleaning unit 15 does not have to be provided.

In the image forming section 2, signal light corresponding to the image information is emitted from the exposure unit 13 to the surface of the photoreceptor drum 11 which has been evenly charged by the charging section 12, thereby forming an electrostatic latent image; the toner is then supplied from the developing device 14 to the electrostatic latent image, thereby forming a toner image; the toner image is transferred to an intermediate transfer belt 25; and the toner which remains on the surface of the photoreceptor drum 11 is removed by the cleaning unit 15. A series of the toner image forming operations just described is repeatedly carried out.

The transfer section 3 is disposed above the photoreceptor drum 11 and includes the intermediate transfer belt 25, a driving roller 26, a driven roller 27, four intermediate transfer rollers 28 which respectively correspond to image information of the colors, i.e. black, cyan, magenta, and yellow, a transfer belt cleaning unit 29, and a transfer roller 30. The intermediate transfer belt 25 is an endless belt stretched between the driving roller 26 and the driven roller 27, thereby forming a loop-shaped travel path. The intermediate transfer belt 25 rotates in an arrow B direction. The driving roller 26 can rotate around an axis thereof with the aid of a driving section (not shown), and the rotation of the driving roller 26 drives the intermediate transfer belt 25 to rotate in the arrow B direction. The driven roller 27 can rotate depending on the rotational drive of the driving roller 26, and imparts constant tension to the intermediate transfer belt 25 so that the intermediate transfer belt 25 does not go slack. The intermediate transfer roller 28 is disposed in pressure-contact with the photoreceptor drum 11 across the intermediate transfer belt 25, and capable of rotating around its own axis by a driving section (not shown). The intermediate transfer roller 28 is connected to a power source (not shown) for applying the transfer bias voltage as described above, and has a function of transferring the toner image formed on the surface of the photoreceptor drum 11 to the intermediate transfer belt 25.

When the intermediate transfer belt 25 passes by the photoreceptor drum 11 in contact therewith, the transfer bias voltage whose polarity is opposite to the polarity of the charged toner on the surface of the photoreceptor drum 11 is applied from the intermediate transfer roller 28 which is disposed opposite to the photoreceptor drum 11 across the intermediate transfer belt 25, with the result that the toner image formed on the surface of the photoreceptor drum 11 is transferred onto the intermediate transfer belt 25. In the case of a multicolor image, the toner images of respective colors formed on the respective photoreceptor drums 11 are sequentially transferred and overlaid onto the intermediate transfer belt 25, thus forming a multicolor toner image.

The transfer belt cleaning unit 29 is disposed opposite to the driven roller 27 across the intermediate transfer belt 25 so as to come into contact with an outer circumferential surface of the intermediate transfer belt 25. The residual toner which is attached to the intermediate transfer belt 25 as it comes into contact with the photoreceptor drum 11, may cause contamination on a reverse side of the recording medium. The transfer belt cleaning unit 29 therefore removes and collects the toner on the surface of the intermediate transfer belt 25.

The transfer roller 30 is disposed in pressure-contact with the driving roller 26 across the intermediate transfer belt 25, and capable of rotating around its own axis by a driving section (not shown). In a pressure-contact portion, i.e., a transfer nip portion, between the transfer roller 30 and the driving roller 26, a toner image which has been carried by the intermediate transfer belt 25 and thereby conveyed to the pressure-contact portion is transferred onto a recording medium fed from the later-described recording medium feeding section 5. The recording medium bearing the toner image is fed to the fixing section 4.

In the transfer section 3, the toner image is transferred from the photoreceptor drum 11 onto the intermediate transfer belt 25 in the pressure-contact portion between the photoreceptor drum 11 and the intermediate transfer roller 28, and by the intermediate transfer belt 25 rotating in the arrow B direction, the transferred toner image is conveyed to the transfer nip portion where the toner image is transferred onto the recording medium.

The fixing section 4 is provided downstream of the transferring section 3 along a conveyance direction of the recording medium, and contains a fixing roller 31 and a pressure roller 32. The fixing roller 31 can rotate by a driving section (not shown), and heats the toner constituting an unfixed toner image borne on the recording medium so that the toner is fused to be fixed on the recording medium. Inside the fixing roller 31 is provided a heating portion (not shown). The heating portion heats the heating roller 31 so that a surface of the heating roller 31 has a predetermined temperature (which may also be hereinafter referred to as "heating temperature"). For the heating portion, a heater, a halogen lamp, and the like device can be used, for example. The heating portion is controlled by a fixing condition controlling portion.

In the vicinity of the surface of the fixing roller 31 is provided a temperature detecting sensor (not shown) which detects a surface temperature of the fixing roller 31. A result detected by the temperature detecting sensor is written to a memory portion of the later-described control unit. The pressure roller 32 is disposed in pressure-contact with the fixing roller 31, and supported so as to be rotate by the rotational drive of the fixing roller 31. The pressure roller 32 helps the toner image to be fixed onto the recording medium by pressing the toner and the recording medium when the heat of the fixing roller 31 fuses the toner and the toner image is thereby fixed onto the recording medium. A pressure-contact portion between the fixing roller 31 and the pressure roller 32 is a fixing nip portion.

In the fixing section 4, the recording medium onto which the toner image has been transferred in the transfer section 3 is nipped by the fixing roller 31 and the pressure roller 32 so that when the recording medium passes through the fixing nip portion, the toner image is pressed and thereby fixed onto the recording medium under heat, whereby an image is formed.

The recording medium feeding section 5 includes an automatic paper feed tray 35, a pickup roller 36, conveying rollers 37, registration rollers 38, and a manual paper feed tray 39. The automatic paper feed tray 35 is disposed in a vertically lower part of the image forming apparatus 100 and in form of a container-shaped member for storing the recording mediums. Examples of the recording medium include plain paper, color copy paper, sheets for overhead projector, and postcards. The pickup roller 36 takes out sheet by sheet the recording mediums stored in the automatic paper feed tray 35, and feeds the recording mediums to a paper conveyance path S1. The conveying rollers 37 are a pair of roller members disposed in pressure-contact with each other, and convey the recording medium toward the registration rollers 38. The registration rollers 38 are a pair of roller members disposed in pressure-contact with each other, and feed to the transfer nip portion the recording medium fed from the conveying rollers 37 in synchronization with the conveyance of the toner image borne on the intermediate transfer belt 25 to the transfer nip portion. The manual paper feed tray 39 is a device storing recording mediums which are different from the recording mediums stored in the automatic paper feed tray 35 and may have any size and which are to be taken into the image forming apparatus, and the recording medium taken in from the manual paper feed tray 39 passes through a paper conveyance path S2 by use of the conveying rollers 37, thereby being fed to the registration rollers 38. In the recording medium feeding section 5, the recording medium supplied sheet by sheet from the automatic paper feed tray 35 or the manual paper feed tray 39 is fed to the transfer nip portion in synchronization with the conveyance of the toner image borne on the intermediate transfer belt 25 to the transfer nip portion.

The discharging section 6 includes the conveying rollers 37, discharging rollers 40, and a catch tray 41. The conveying rollers 37 are disposed downstream of the fixing nip portion along the paper conveyance direction, and convey toward the discharging rollers 40 the recording medium onto which the image has been fixed by the fixing section 4. The discharging rollers 40 discharge the recording medium onto which the image has been fixed, to the catch tray 41 disposed on a vertically upper surface of the image forming apparatus 100. The catch tray 41 stores the recording medium onto which the image has been fixed.

The image forming apparatus 100 includes a control unit (not shown). The control unit is disposed, for example, in an upper part of an internal space of the image forming apparatus 100, and contains a memory portion, a computing portion, and a control portion. To the memory portion of the control unit are input, for example, various set values obtained by way of an operation panel (not shown) disposed on the upper surface of the image forming apparatus 100, results detected from a sensor (not shown) etc. disposed in various portions inside the image forming apparatus 100, and image information obtained from external equipment. Further, programs for operating various functional elements are written. Examples of the various functional elements include a recording medium determining portion, an attachment amount controlling portion, and a fixing condition controlling portion. For the memory portion, those customarily used in the relevant filed can be used including, for example, a read only memory (ROM), a random access memory (RAM), and a hard disc drive (HDD). For the external equipment, it is possible to use electrical and electronic devices which can form or obtain the image information and which can be electrically connected to the image forming apparatus 100. Examples of the external equipment include a computer, a digital camera, a television, a video recorder, a DVD (digital versatile disc) recorder, an HDDVD (high-definition digital versatile disc), a Blu-ray disc recorder, a facsimile machine, and a mobile computer. The computing portion of the control unit takes out the various data (such as an image formation order, the detected result, and the image information) written in the memory portion and the programs for various functional elements, and then makes various determinations. The control portion of the control unit sends to a relevant device a control signal in accordance with the result determined by the computing portion, thus performing control on operations. The control portion and the computing portion include a processing circuit which is achieved by a microcomputer, a microprocessor, etc. having a central processing unit (abbreviated as CPU). The control unit contains a main power source as well as the above-stated processing circuit. The power source supplies electricity to not only the control unit but also respective devices provided inside the image forming apparatus 100.

5. Developing device

Figure 4:
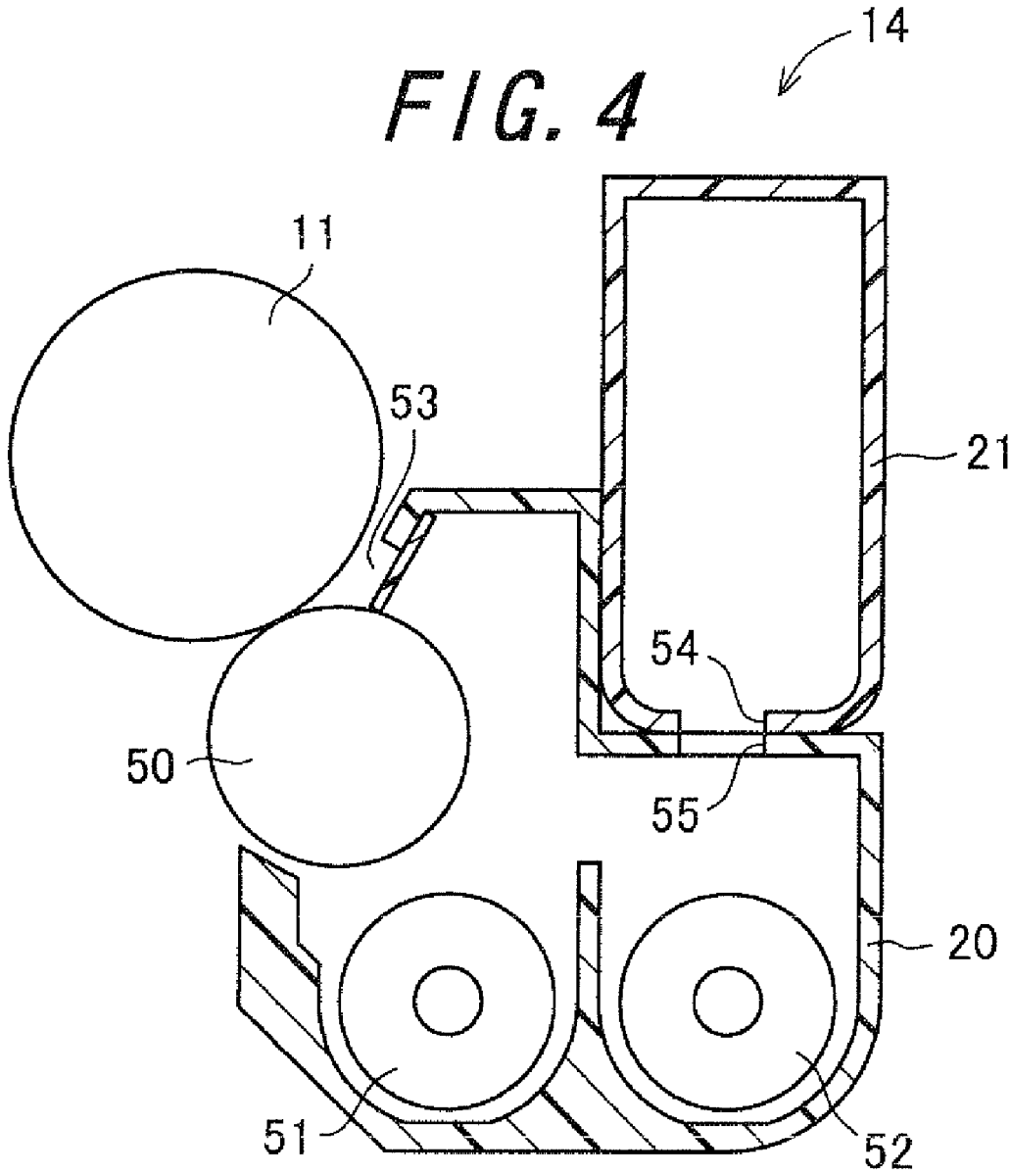
FIG. 4 is a sectional view schematically showing a developing device provided in the image forming apparatus shown in FIG. 3.

FIG. 4 is a schematic view showing the developing device 14 provided in the image forming apparatus 100 shown in FIG. 3. The developing device 14 includes a developing tank 20 and a toner hopper 21. The developing tank 20 is a container-shaped member which is disposed so as to face the surface of the photoreceptor drum 11 and used to supply a toner to an electrostatic latent image formed on the surface of the photoreceptor drum 11 so as to develop the electrostatic latent image into a visualized images i.e. a toner image. The developing tank 20 contains the toner in its internal space where roller members such as a developing roller 50, a supplying roller 51, and an agitating roller 52, are placed as being rotatably supported. Instead of the roller members, screw members may be placed in the developing tank 20. In the developing device 14 of the present embodiment, the above-described toner according to one embodiment of the invention is contained in the developing tank 20.

The developing tank 20 has an opening 53 in a side face thereof opposed to the photoreceptor drum 11. The developing roller 50 is rotatably provided at such a position as to face the photoreceptor drum 11 through the opening 53 just stated. The developing roller 50 is a roller-shaped member for supplying a toner to the electrostatic latent image on the surface of the photoreceptor drum 11 in a pressure-contact portion or most-adjacent portion between the developing roller and the photoreceptor drum 11. In supplying the toner, to a surface of the developing roller 50 is applied potential whose polarity is opposite to polarity of the potential of the charged toner, which serves as development bias voltage. By so doing, the toner on the surface of the developing roller 50 is smoothly supplied to the electrostatic latent image. Furthermore, an amount of the toner being supplied to the electrostatic latent image, that is, a toner attachment amount on the electrostatic latent image can be controlled by changing a value of the development bias voltage.

The supplying roller 51 is a roller-shaped member which is rotatably disposed so as to face the developing roller 50 and used to supply the toner to the vicinity of the developing roller 50.

The agitating roller 52 is a roller-shaped member which is rotatably disposed so as to face the supplying roller 51 and used to feed to the vicinity of the supplying roller 51 the toner which is newly supplied from the toner hopper 21 into the developing tank 20. The toner hopper 21 is disposed so as to communicate a toner replenishment port 54 formed in a vertically lower part of the toner hopper 21, with a toner reception port 55 formed in a vertically upper part of the developing tank 20. The toner hopper 21 replenishes the developing tank 20 with the toner according to toner consumption. Further, it may be possible to adopt such configuration that the developing tank 20 is replenished with the toner supplied directly from a toner cartridge of each color without using the toner hopper 21.

As described above, the developing device 14 preferably develops latent images by using the developer of the invention. Since the latent images are developed by using the developer of the invention, toner images at high definition can be formed stably to the photoreceptor drum 11. Accordingly, high quality images at high definition with no fogging can be formed stably.

Further, according to the invention, it is preferred to obtain the image forming apparatus 100 including the photoreceptor drum 11 to which latent images are formed, the charge unit 12 and the exposure unit 13 forming latent images to the photoreceptor drum 11, and the developing device 14 of the invention capable of forming toner images at high definition to the photoreceptor drum 11. By forming images by the image forming apparatus 100 as described above, high quality images at high definition can be formed stably.

EXAMPLES

The invention is to be described specifically with reference to examples and comparative examples. The number average particle size of the toner, the coefficient of variation CV of the toner and the shape factor SF1 of the toner in the examples and the comparative examples were measured as described below.

[Number Average Particles Size and Coefficient of Variation CV of Toner]

Measurement of the toner particles by a flow particle image analyzer was carried out by preparing a specimen as described below and using model FPIA-2000 (manufactured by Symex Corporation). At first, 20 mL of an aqueous 1 wt % solution (electrolyte) of sodium chloride (extra-pure grade) was placed in a 100 mL beaker. 0.5 mL of an alkylbenzene sulfonate salt (dispersant), and 3 mg of a toner specimen were added successively thereto and supersonically dispersed for 5 min. An aqueous 1 wt % solution of sodium chloride (extra-pure grade) was added so as to make up total amount to 100 ml and supersonically dispersed again for 5 min, which was used as a specimen to be measured. For the specimen to be measured, static images of toner particles dispersed in the specimen to be measured were photographed and subjected to image analysis by model FPIA-2000 to determine the circle-equivalent diameter of the toner particles. The number average particle size of the toner and the coefficient of variation CV of the toner were calculated based on the particle size distribution obtained as described above.

[Shape Factor SF1 of Toner]

The toner was photographed by SEM VE-9800 (manufactured by Keyence Corporation) at 1000× for the specimens by the number of about 500 (they may be taken for a plurality of sheets). The images were analyzed by an image analysis software were "A-ZO-KUN" (manufactured by Asahi Kasei Engineering Corporation), to determine SF1.

Example 1

81.8 parts by weight of a polyester (binder resin, trade name: FC1494, manufactured by Mitsubishi Rayon Co., glass transition temperature (Tg) at 62° C., softening point (Tm) at 127° C.), 12 parts by weight of a master batch (containing 40 wt % C.I. Pigment Red 57:1), 4.2 parts by weight of paraffin wax (release agent; trade name: HNP11, manufactured by Nippon Seiro Co., Ltd., melting point at 68° C.), and 1.5 parts by weight of a metal alkyl salicylate salt (charge controller, trade name: BONTRON E-84, manufactured by Orient Chemical Industries, Ltd.) were mixed in a Henschel mixer for 10 min to prepare a mixture, and the mixture was melt-kneaded by a twin screw kneader extruder (trade name: PCM 65, manufactured by Ikegai Co.) to prepare a melt-kneaded product. The obtained melt-kneaded product was charged by the amount described below together with a dispersant to a PUC colloid mill (trade name, manufactured by Nippon Ball Valve Co., Ltd.), and wet-pulverized to obtain an aqueous slurry containing a coarse powder of the melt-kneaded product.

| | |
|---|---|
| Melt-kneaded product | 900 parts by weight |
| Polyacrylic acid (trade name: NEW COAL 10N manufactured by Nippon Nyukazai Co., Ltd.) | 45 parts by weight |
| Moistening agent (trade name: AEROLE, manufactured by Toho Chemical Industry Co., Ltd.) | 2 parts by weight |
| Ion exchanged water | 2053 parts by weight |

An aqueous slurry containing fine toner particles was obtained by treating an aqueous slurry containing the coarse powder of the melt-kneaded product by using a high pressure homogenizer NANO3000 (trade name, manufactured by Beryu Co., Ltd.) under the following conditions.

<Treating Condition>

| | |
|---|---|
| Pressure | 210 MPa |
| Temperature | 200° C. |
| Nozzle diameter | 0.09 mm |

An aqueous slurry containing a first group of toner particles was prepared by adding a coagulant to the aqueous slurry containing fine toner particles by the following amount and coagulating them under the following conditions by using CLEARMIX W-MOTION.

<Specimen>

| | |
|---|---|
| Aqueous slurry containing fine toner particles | 600 parts by weight |
| Coagulant (sodium chloride, extra-pure grade; manufactured by Wako Pure Chemical Industries, Ltd.) | 15 parts by weight |

<Coagulation Codition>

| | |
|---|---|
| Temperature | 70° C. |
| Number of rotation (rotor/stator) | 15000 rpm/13500 rpm |
| Setting temperature retaining time | 10 min |

An aqueous slurry containing a second group of toner particles was prepared in the same manner as in the method of preparing the aqueous slurry containing the first group of toner particles except for coagulating the aqueous slurry containing the fine toner particles under the following conditions.

<Specimen>

| | |
|---|---|
| Aqueous slurry containing fine toner particles | 600 parts by weight |
| Coagulant (sodium chloride, extra-pure grade, manufactured by Wako Pure Chemical Industries, Ltd.) | 24 parts by weight |

<Coagulation Condition>

| | |
|---|---|
| Temperature | 75° C. |
| Number of rotation (rotor/stator) | 13000 rpm/11700 rpm |
| Setting temperature retaining time | 10 min |

A first group of toner particles and a second group of toner particles were obtained by sufficiently washing the aqueous slurry containing the first group of toner particles and the aqueous slurry containing the second group of toner particles obtained as described above with ion exchanged water and then drying them, respectively. The number-based average particle size and the coefficient of variation measured by a flow particle image analyzer (model FPIA-2000) were as shown below.

First Group of Toner Particles:

Number average particle size (μm): 2.91

Coefficient of variation: 22.1

Second Group of Toner Particles:

Number average particle size (μm): 4.60

Coefficient of variation: 24.7

3 parts by weight of the first group of toner particles and 100 parts by weight of the second group of toner particles were mixed and 1.5 parts by weight of fine silica particles (trade name: R972, manufactured by Nippon Aerosil Co., Ltd.) was added externally as an external additive, and the obtained group of toner particles was used as the toner of Example 1.

Example 2

A toner containing a first group of toner particles and a second group of toner particles having the number average particle sizes shown below was prepared by a suspension polymerization method.

First Group of Toner Particles:

Number average particle size (μm): 2.58

Coefficient of variation: 24.1

Second Group of Toner Particles:

Number average particle size (μm): 4.68

Coefficient of variation: 24.0

3 parts by weight of the first group of toner particles and 100 parts by weight of the second group of toner particles were mixed and 1.5 parts by weight of fine silica particles (trade name: R972, manufactured by Nippon Aerosil Co., Ltd.) was added externally as the external additive, and the obtained group of toner particles was used as the toner of Example 2.

Example 3

1.0 part by weight of a group of toner particles obtained by sufficiently washing the aqueous slurry containing fine toner particles prepared in Example 1, and drying the same (number average particle size: 1.24 μm, coefficient of variation: 37.8), 3.0 parts by weight of the first group of toner particles obtained in Example 1, and 100 parts by weight of the second group of toner particles obtained in Example 1 were mixed, and 1.5 parts by weight of fine silica particles (trade name: R972, manufactured by Nippon Aerosil Co., Ltd.) as the external additive was added externally, and the obtained group of toner particles was used as the toner of Example 3.

Example 4

2.2 parts by weight of the first group of toner particles obtained in Example 1 and 100.8 parts by weight of a second group of toner particles obtained in Example 1 were mixed, and 1.5 parts by weight of fine silica particles (trade name: R972, manufactured by Nippon Aerosil Co., Ltd.) was added externally as the external additive, and the obtained group of toner particles was used as the toner of Example 4.

Example 5

An aqueous slurry containing the second group of toner particles was prepared by coagulating the aqueous slurry containing fine toner particles obtained in Example 1 under the following conditions.

<Specimen>

| | |
|---|---|
| Aqueous slurry containing fine toner particles | 600 parts by weight |
| Coagulant (sodium chloride, extra-pure grade, manufactured by Wako Pure Chemical Industries, Ltd.) | 26 parts by weight |

<Coagulation Condition>

| | |
|---|---|
| Temperature | 75° C. |
| Number of rotation (rotor/stator) | 15000 rpm/13500 rpm |
| Setting temperature retaining time | 10 min |

A second group of toner particles was obtained by sufficiently washing the aqueous slurry containing the second group of toner particles obtained as described above with ion exchanged water and then drying the same. The number-based average particle size and the coefficient of variation measured for the second group of toner particles by a flow particle image analyzer (model FPIA-2000) were as shown below.

Second Group of Toner Particles:

Number average particle size (μm): 5.12

Coefficient of variation: 22.1

3.0 parts by weight of the first group of toner particles obtained in Example 1 and 100 parts by weight of the second group of toner particles obtained in Example 5 were mixed, and 1.5 parts by weight of fine silica particles (trade name: R972, manufactured by Nippon Aerosil Co., Ltd.) was added externally as the external additive, and the obtained group of toner particles was used as the toner of Example 5.

Example 6

4.6 parts by weight of the first group of toner particles obtained in Example 1 and 100 parts by weight of the second group of toner particles obtained in Example 1 were mixed, and 1.5 parts by weight of fine silica particles (trade name: R972, manufactured by Nippon Aerosil Co., Ltd.) was added externally as the external additive and the obtained group of toner particles was used as the toner of the Example 6.

Example 7

1.9 parts by weight of the first group of toner particles obtained in Example 1 and 100 parts by weight of the second group of toner particles obtained in Example 5 were mixed, and 1.5 parts by weight of fine silica particles (trade name: R972, manufactured by Nippon Aerosil Co., Ltd.) was added externally as the external additive, and the obtained group of toner particles was used as the toner of Example 7.

Example 8

3.6 parts by weight of the first group of toner particles obtained in Example 1 and 100 parts by weight of the second group of toner particles obtained in Example 5 were mixed, and 1.5 parts by weight of fine silica particles (trade name: R972, manufactured by Nippon Aerosil Co., Ltd.) was added externally as the external additive, and the obtained group of toner particles was used as the toner of Example 8.

Example 9

An aqueous slurry containing a second group of toner particles was prepared by coagulating the aqueous slurry containing fine toner particles obtained in Example 1 under the following conditions.

<Specimen>

| | |
|---|---|
| Aqueous slurry containing fine toner particles | 600 parts by weight |
| Coagulant (sodium chloride, extra-pure grade, manufactured by Wako Pure Chemical Industries, Ltd.) | 24 parts by weight |

<Coagulation Condition>

| | |
|---|---|
| Temperature | 75° C. |
| Number of rotation (rotor/stator) | 17000 rpm/15300 rpm |
| Setting temperature retaining time | 10 min |

A second group of toner particles was obtained by sufficiently washing the aqueous slurry containing the second group of toner particles obtained as described above with ion exchanged water and then drying the same. The number-based average particle size and the coefficient of variation for the second group of toner particles measured by a flow particle image analyzer (model FPIA-2000) were as shown below.

Second Group of Toner Particles:

Number average particle size (μm): 4.24

Coefficient of variation: 23.6

3.0 parts by weight of the first group of toner particles obtained in Example 1 and 100 parts by weight of the second group of toner particles obtained in Example 9 were mixed, and 1.5 parts by weight of fine silica particles (trade name: R972, manufactured by Nippon Aerosil Co., Ltd.) was added externally as the external additive, and the obtained group of toner particles was used as the toner of Example 9.

Example 10

An aqueous slurry containing a second group of toner particles was prepared by coagulating the aqueous slurry containing fine toner particles obtained in Example 1 under the following conditions.

<Specimen>

| | |
|---|---|
| Aqueous slurry containing fine toner particles | 600 parts by weight |
| Coagulent (sodium chloride, extra-pure grade, manufactured by Wako Pure Chemical Industries, Ltd.) | 26 parts by weight |

<Coagulation Condition>

| | |
|---|---|
| Temperature | 75° C. |
| Number of rotation (rotor/stator) | 19000 rpm/17100 rpm |
| Setting temperature retaining time | 10 min |

A second group of toner particles was obtained by sufficiently washing the aqueous slurry containing the second group of the toner particles obtained as described above with ion exchanged water and then drying the same. The number-based average particle size and the coefficient of variation measured by a flow particle image analyzer (model FPIA-2000) were as shown below.

Second Group of Toner Particles:

Number average particle size (μm): 4.78

Coefficient of variation: 29.5

1.5 parts by weight of fine silica particles (trade name: R972, manufactured by Nippon Aerosil Co., Ltd.) was added externally as the external additive to 100 parts by weight of the second group of toner particles obtained in Example 10, and the obtained group of toner particles was used as the toner of Example 10.

Example 11

An aqueous slurry containing a first group of toner particles was prepared by adding a coagulant to the aqueous slurry containing fine toner particles obtained in Example 1 and coagulating the same under the following conditions by using CLEARMIX W-MOTION.

<Specimen>

| | |
|---|---|
| Aqueous slurry containing fine toner particles | 600 parts by weight |
| Coagulant (sodium chloride, extra-pure grade manufactured by Wako Pure Chemical Industries, Ltd.) | 18 parts by weight |

<Coagulation Condition>

| | |
|---|---|
| Temperature | 70° C. |
| Number of rotation (rotor/stator) | 18000 rpm/16200 rpm |
| Setting temperature retaining time | 10 min |

A first group of toner particles was obtained by sufficiently washing the aqueous slurry containing the first group of the toner particles obtained as described above with ion exchanged water and then drying the same. The number-based average particle size and the coefficient of variation measured by a flow particle image analyzer (model FPIA2000) were as shown below.

First Group of Toner Particles:

Number average particle size (μm): 2.98

Coefficient of variation: 16.4

3.4 parts by weight of the first group of toner particles obtained in Example 11 and 100 parts by weight of the first group of toner particles obtained in Example 1 were mixed, and 1.5 parts by weight of fine silica particles (trade name: R972, manufactured by Nippon Aerosil Co., Ltd.) was added externally as the external additive, and the obtained group of toner particles was used as the toner of Example 11.

Example 12

An aqueous slurry containing a fine particles obtained in Example 1 were coagulated under the following conditions to prepare an aqueous slurry containing a second group of toner particles.

<Specimen>

| | |
|---|---|
| Aqueous slurry containing fine toner particles | 600 parts by weight |
| Coagulant (sodium chloride, extra-pure grade manufactured by Wako Pure Chemical Industries, Ltd.) | 24 parts by weight |

<Coagulation Condition>

| | |
|---|---|
| Temperature | 75° C. |
| Number of rotation (rotor/stator) | 19000 rpm/17100 rpm |
| Setting temperature retaining time | 20 min |

A second group of toner particles was obtained by sufficiently washing an aqueous slurry obtaining the second group of toner particles obtained as described above with ion exchanged water and then drying the same. The number-based average particle size and the coefficient of variation measured by the flow particle image analyzer (Model FPIA-2000) were as shown below.

Second Group of Toner Particles:

Number average particle size (μm): 4.82

Coefficient of variation: 19.4

3.3 parts by weight of the first group of toner particles obtained in Example 1 and 100 parts by weight of the second group of toner particles obtained in Example 12 were mixed, and 1.5 parts by weight of fine silica particles (trade name: R972, manufactured by Nippon Aerosil Co., Ltd.) was added externally as the external additive, and the obtained group of toner particles was used as the toner of Example 12.

Comparative Example 1

1.5 parts by weight of a group of toner particles obtained by sufficiently washing the aqueous slurry containing fine toner particles prepared in Example 1, and drying the same (number average particle size: 1.24 μm, coefficient of variation: 37.8), 3.0 parts by weight of the first group of toner particles obtained in Example 1, and 100 parts by weight of the second group of toner particles obtained in Example 1 were mixed, and 1.5 parts by weight of fine silica particles was added externally as the external additive and the obtained group of toner particles was used as the toner of Comparative Example 1.

Comparative Example 2

1.8 parts by weight of the first group of toner particles obtained in Example 1 and 100 parts by weight of the second group of toner particles obtained in Example 1 were mixed, and 1.5 parts by weight of fine silica particles (trade name: R972, manufactured by Nippon Aerosil Co., Ltd.) was added externally as the external additive, and the obtained group of toner particles was used as the toner of Comparative Example 2.

Comparative Example 3

2.2 parts by weight of the first group of toner particles obtained in Example 1 and 100 parts by weight of the second group of toner particles obtained in Example 5 were mixed, and 1.5 parts by weight of fine silica particles (trade name: R972, manufactured by Nippon Aerosil Co., Ltd.) was added externally as the external additive, and the obtained group of toner particles was used as the toner of Comparative Example 3.

Comparative Example 4

5.1 parts by weight of the first group of toner particles obtained in Example 1 and 100 parts by weight of the second group of toner particles obtained in Example 1 were mixed, and 1.5 parts by weight of fine silica particles (trade name: R972, manufactured by Nippon Aerosil Co., Ltd.) was added externally as the external additive, and the obtained group of toner particles was used as the toner of Comparative Example 4.

Comparative Example 5

1.3 parts by weight of the first group of toner particles obtained in Example 1 and 100 parts by weight of the second group of toner particles obtained in Example 5 were mixed, and 1.5 parts by weight of fine silica particles (trade name: R972, manufactured by Nippon Aerosil Co., Ltd.) was added externally as the external additive, and the obtained group of toner particles was used as the toner of Comparative Example 5.

Comparative Example 6

1.1 parts by weight of the first group of toner particles obtained in Example 1 and 100 parts by weight of the second group of toner particles obtained in Example 5 were mixed, and 1.5 parts by weight of fine silica particles (trade name: R972, manufactured by Nippon Aerosil Co., Ltd.) was added externally as the external additive, and the obtained group of toner particles was used as the toner of Comparative Example 6.

Comparative Example 7

4.2 parts by weight of the first group of toner particles obtained in Example 1 and 100 parts by weight of the second group of toner particles obtained in Example 5 were mixed, and 1.5 parts by weight of fine silica particles (trade name: R972, manufactured by Nippon Aerosil Co., Ltd.) was added externally as the external additive, and the obtained group of toner particles was used as the toner of Comparative Example 7.

Comparative Example 8

An aqueous slurry containing a first group of toner particles was prepared by adding a coagulant to the aqueous slurry containing the fine toner particles obtained in Example 1 and coagulating the same by CLEARMIX W-MOTION under the following conditions.

<Specimen>

| | |
|---|---|
| Aqueous slurry containing fine toner particles | 600 parts by weight |
| Coagulant (sodium chloride, extra-pure grade, manufactured by Wako Pure Chemical Industries, Ltd.) | 15 parts by weight |

<Coagulation Condition>

| | |
|---|---|
| Temperature | 70° C. |
| Number of rotation (rotor/stator) | 17000 rpm/15300 rpm |
| Setting temperature retaining time | 10 min |

A first group of toner particles was obtained by sufficiently washing the aqueous slurry containing the first group of the toner particles obtained as described above with ion exchanged water and then drying the same. The number-based average particle size and the coefficient of variation measured by a flow particle image analyzer (model FPIA-2000) were as shown below.

First Group of Toner Particles:

Number average particle size (μm): 2.52

Coefficient of variation: 23.8

5.0 parts by weight of the first group of toner particles obtained in Comparative Example 8 and 100 parts by weight of the second group of toner particles obtained in Example 5 were mixed, and 1.5 parts by weight of fine silica particles (trade name: R972, manufactured by Nippon Aerosil Co., Ltd.) was added externally as the external additive, and the obtained group of toner particles was used as the toner of Comparative Example 8.

Comparative Example 9

2.0 parts by weight of the first group of toner particles obtained in Example 11 and 100 parts by weight of the second group of toner particles obtained in Example 9 were mixed, and 1.5 parts by weight of fine silica particles (trade name: R972, manufactured by Nippon Aerosil Co., Ltd.) was added externally as the external additive, and the obtained group of toner particles was used as the toner of Comparative Example 9.

Comparative Example 10

An aqueous slurry containing a first group of toner particles was prepared by adding a coagulant to the aqueous slurry containing the fine toner particles obtained in Example 1 and coagulating the same by CLEARMIX W-MOTION under the following conditions.

<Specimen>

| | |
|---|---|
| Aqueous slurry containing fine toner particles | 600 parts by weight |
| Coagulant (sodium chloride, extra-pure grade, manufactured by Wako Pure Chemical Industries, Ltd.) | 18 parts by weight |

<Coagulation Condition>

| | |
|---|---|
| Temperature | 70° C. |
| Number of rotation (rotor/stator) | 18000 rpm/16200 rpm |
| Setting temperature retaining time | 20 min |

A first group of toner particles was obtained by sufficiently washing the aqueous slurry containing the first group of the toner particles obtained as described above with ion exchanged water and then drying the same. The number-based average particle size and the coefficient of variation measured by a flow particle image analyzer (model FPIA-2000) were as shown below.

First Group of Toner Particles:

Number average particle size (μm): 3.11

Coefficient of variation: 15.1

2.8 parts by weight of the first group of toner particles obtained in Comparative Example 10 and 100 parts by weight of the second group of toner particles obtained in Example 1 were mixed, and 1.5 parts by weight of fine silica particles (trade name: R972, manufactured by Nippon Aerosil Co., Ltd.) was added externally as the external additive, and the obtained group of toner particles was used as the toner of Comparative Example 10.

Comparative Example 11

An aqueous slurry containing a first group of toner particles was prepared by adding a coagulant to the aqueous slurry containing the fine toner particles obtained in Example 1 and coagulating the same by CLEARMIX W-MOTION under the following conditions.

<Specimen>

| | |
|---|---|
| Aqueous slurry containing fine toner particles | 600 parts by weight |
| Coagulant (sodium chloride, extra-pure grade, manufactured by Wako Pure Chemical Industries, Ltd.) | 15 parts by weight |

<Coagulation Condition>

| | |
|---|---|
| Temperature | 70° C. |
| Number of rotation (rotor/stator) | 15000 rpm/13500 rpm |
| Setting temperature retaining time | 5 min |

A first group of toner particles was obtained by sufficiently washing the aqueous slurry containing the first group of the toner particles obtained as described above with ion exchanged water and then drying the same. The number-based average particle size and the coefficient of variation measured by a flow particle image analyzer (model FPIA-2010) were as shown below.

First Group of Toner Particles:

Number average particle size (μm): 2.57

Coefficient of variation: 26.4

2.8 parts by weight of the first group of toner particles obtained in Comparative Example 11 and 100 parts by weight of the second group of toner particles obtained in Example 1 were mixed, and 1.5 parts by weight of fine silica particles (trade name: R972, manufactured by Nippon Aerosil Co., Ltd.) was added externally as the external additive, and the obtained group of toner particles was used as the toner of Comparative Example 11.

Comparative Example 12

The aqueous slurry containing fine toner particles obtained in Example 1 was coagulated under the following conditions to prepare an aqueous slurry containing a second group of toner particles.

<Specimen>

| | |
|---|---|
| Aqueous slurry containing fine toner particles | 600 parts by weight |
| Coagulant (sodium chloride, extra-pure grade, manufactured by Wako Pure Chemical Industries, Ltd.) | 24 parts by weight |

<Coagulation Condition>

| | |
|---|---|
| Temperature | 75° C. |
| Number of rotation (rotor/stator) | 19000 rpm/17100 rpm |
| Setting temperature retaining time | 40 min |

A second group of toner particles was obtained by sufficiently washing the aqueous slurry containing the second group of the toner particles obtained as described above with ion exchanged water and then drying the same. The number-based average particle size and the coefficient of variation measured by a flow particle image analyzer (model FPIA-2000) were as shown below.

Second Group of Toner Particles:

Number average particle size (μm): 4.55

Coefficient of variation: 18.1

2.7 parts by weight of the first group of toner particles obtained in Example 1 and 100 parts by weight of the second group of toner particles obtained in Comparative Example 12 were mixed, and 1.5 parts by weight of fine silica particles (trade name: R972, manufactured by Nippon Aerosil Co., Ltd.) was added externally as the external additive, and the obtained group of toner particles was used as the toner of Comparative Example 12.

Comparative Example 13

The aqueous slurry containing fine toner particles obtained in Example 1 was coagulated under the following conditions to prepare an aqueous slurry containing a second group of toner particles.

<Specimen>

| | |
|---|---|
| Aqueous slurry containing fine toner particles | 600 parts by weight |
| Coagulant (sodium chloride, extra-pure grade, manufactured by Wako Pure Chemical Industries, Ltd.) | 24 parts by weight |

<Coagulation Condition>

| | |
|---|---|
| Temperature | 75° C. |
| Number of rotation (rotor/stator) | 13000 rpm/11700 rpm |
| Setting temperature retaining time | 5 min |

A second group of toner particles was obtained by sufficiently washing the aqueous slurry containing the second group of the toner particles obtained as described above with ion exchanged water and then drying the same. The number-based average particle size and the coefficient of variation measured by a flow particle image analyzer (model FPIA-2000) were as shown below.

Second Group of Toner Particles:

Number average particle size (μm): 4.67

Coefficient of variation: 30.8

2.5 parts by weight of the first group of toner particles obtained in Example 1 and 100 parts by weight of the second group of toner particles obtained in Comparative Example 13 were mixed, and 1.5 parts by weight of fine silica particles (trade name: R972, manufactured by Nippon Aerosil Co., Ltd.) was added externally as the external additive, and the obtained group of toner particles was used as the toner of Comparative Example 13.

Comparative Example 14

A first group of toner particles and s second group of toner particles were obtained by coarsely pulverizing the melt-kneaded product prepared in Example 1 by a cutting mill (trade name of product: VM-16, manufactured by Ryoko Industry Ltd.), then finely pulverizing by a counter jet mill and removing excessively pulverized toner by classification using a rotary type classifier. The number-based average particle size and the coefficient of variation measured by a flow particle image analyzer (Model FPIA-2000) were as shown below.

First Group of Toner Particles:

Number average particle size (μm): 2.63

Coefficient of variation: 24.7

Second Group of Toner Particles:

Number average particle size (μm): 4.75

Coefficient of variation: 26.1

3 parts by weight of the first group of toner particles obtained in Comparative Example 14 and 100 parts by weight of the second group of toner particles obtained in Comparative Example 14 were mixed, and 1.5 parts by weight of fine silica particles (trade name: R972, manufactured by Nippon Aerosil Co., Ltd.) was added externally as the external additive, and the obtained group of toner particles was used as the toner of Comparative Example 14.

Comparative Example 15

A second group of toner particles was obtained in the same manner as in Example 1 except for changing the temperature in coagulation upon preparation of an aqueous slurry containing a second group of toner particles from 75° C. to 80° C. and changing the addition amount of the coagulant from 24 parts by weight to 12 parts by weight. The number-based average particle size and the coefficient of variation measured by a flow particle image analyzer (Model FPIA-2000) were as shown below.

Second Group of Toner Particles:

Number average particle size (μm): 4.72

Coefficient of variation: 22.3

3 parts by weight of the first group of toner particles obtained in Example 1 and 100 parts by weight of the second group of toner particles obtained in Comparative Example 15 were mixed, and 1.5 parts by weight of fine silica particles (trade name: R972, manufactured by Nippon Aerosil Co., Ltd.) was added externally as the external additive, and the obtained group of toner particles was used as the toner of Comparative Example 15

Physical properties of the toners obtained in Examples 1 to 12 and Comparative Examples 1 to 15 are collectively shown in Table 1.

TABLE 1

| | Particles before mixing | | | | Particles after mixing | |
|---|---|---|---|---|---|---|
| | First group of toner particles | | Second group of toner particles | | | |
| | Number average particle size (μm) | Coefficient of variation (%) | Number average particle size (μm) | Coefficient of variation (%) | Number ratio A/B | Particle size ratio r/R |
| Ex. 1 | 2.91 | 22.1 | 4.6 | 24.7 | 0.5 | 0.63 |
| Ex. 2 | 2.58 | 24.1 | 4.68 | 24 | 0.44 | 0.55 |
| Ex. 3 | 2.91 | 22.1 | 4.6 | 24.7 | 0.5 | 0.63 |
| Ex. 4 | 2.91 | 22.1 | 4.6 | 24.7 | 0.36 | 0.63 |
| Ex. 5 | 2.91 | 22.1 | 5.12 | 22.1 | 0.55 | 0.57 |
| Ex. 6 | 2.91 | 22.1 | 4.6 | 24.7 | 0.54 | 0.63 |
| Ex. 7 | 2.91 | 22.1 | 5.12 | 22.1 | 0.3 | 0.57 |
| Ex. 8 | 2.91 | 22.1 | 5.12 | 22.1 | 0.59 | 0.57 |
| Ex. 9 | 2.91 | 22.1 | 4.24 | 23.6 | 0.32 | 0.69 |
| Ex. 10 | — | — | 4.78 | 29.5 | 0.31 | 0.58 |
| Ex. 11 | 2.98 | 16.4 | 4.6 | 24.7 | 0.49 | 0.65 |
| Ex. 12 | 2.91 | 22.1 | 4.82 | 19.4 | 0.5 | 0.6 |
| Comp. Ex. 1 | 2.91 | 22.1 | 4.6 | 24.7 | 0.5 | 0.63 |
| Comp. Ex. 2 | 2.91 | 22.1 | 4.6 | 24.7 | 0.31 | 0.63 |
| Comp. Ex. 3 | 2.91 | 22.1 | 5.12 | 22.1 | 0.6 | 0.57 |
| Comp. Ex. 4 | 2.91 | 22.1 | 4.6 | 24.7 | 0.57 | 0.63 |
| Comp. Ex. 5 | 2.91 | 22.1 | 5.12 | 22.1 | 0.3 | 0.57 |
| Comp. Ex. 6 | 2.91 | 22.1 | 5.12 | 22.1 | 0.29 | 0.57 |
| Comp. Ex. 7 | 2.91 | 22.1 | 5.12 | 22.1 | 0.61 | 0.57 |
| Comp. Ex. 8 | 2.52 | 23.8 | 5.12 | 22.1 | 0.38 | 0.49 |
| Comp. Ex. 9 | 2.98 | 16.4 | 4.24 | 23.6 | 0.3 | 0.7 |
| Comp. Ex. 10 | 3.11 | 15.1 | 4.6 | 24.7 | 0.31 | 0.68 |
| Comp. Ex. 11 | 2.57 | 26.4 | 4.6 | 24.7 | 0.44 | 0.56 |
| Comp. Ex. 12 | 2.91 | 22.1 | 4.55 | 18.1 | 0.59 | 0.64 |
| Comp. Ex. 13 | 2.91 | 22.1 | 4.67 | 30.8 | 0.31 | 0.62 |
| Comp. Ex. 14 | 2.63 | 24.7 | 4.75 | 26.1 | 0.43 | 0.55 |
| Comp. Ex. 15 | 2.91 | 22.1 | 4.72 | 22.3 | 0.5 | 0.62 |

| | Particles after mixing | | | | | |
|---|---|---|---|---|---|---|
| | Particle size distribution | | | | | |
| | Number average particle size (μm) | Coefficient of variation (%) | Content of small size particle (% by number) | Content of medium size particle (% by number) | Content of large size particle (% by number) | Shape SF1 |
| Ex. 1 | 4.32 | 27.3 | 2.36 | 26.55 | 52.71 | 135 |
| Ex. 2 | 4.45 | 28.1 | 3.81 | 24.99 | 57.34 | 133 |
| Ex. 3 | 4.3 | 28.6 | 4.85 | 25.91 | 51.34 | 133 |
| Ex. 4 | 4.51 | 24.3 | 1.86 | 20.89 | 58.67 | 137 |
| Ex. 5 | 4.82 | 29.4 | 1.53 | 29.1 | 52.7 | 133 |
| Ex. 6 | 4.28 | 27.1 | 3.14 | 27.24 | 50.2 | 130 |
| Ex. 7 | 4.84 | 29.1 | 1.31 | 21.17 | 69.41 | 135 |
| Ex. 8 | 4.2 | 28.5 | 4.21 | 29.54 | 50.16 | 132 |
| Ex. 9 | 4.11 | 26.2 | 2.11 | 22.2 | 68.9 | 133 |
| Ex. 10 | 4.78 | 29.5 | 1.12 | 20.05 | 65.34 | 139 |
| Ex. 11 | 4.43 | 25.3 | 0.87 | 27.12 | 55.64 | 136 |
| Ex. 12 | 4.52 | 24.6 | 2.67 | 26.43 | 52.73 | 135 |
| Comp. Ex. 1 | 4.19 | 32.1 | 5.37 | 25.77 | 51.06 | 135 |
| Comp. Ex. 2 | 4.39 | 23.8 | 1.51 | 19.21 | 61.17 | 137 |
| Comp. Ex. 3 | 4.73 | 28.7 | 3.56 | 31.21 | 52.11 | 133 |
| Comp. Ex. 4 | 4.21 | 28.3 | 3.71 | 28.34 | 49.71 | 130 |
| Comp. Ex. 5 | 4.89 | 27.9 | 1.22 | 21.08 | 71.02 | 135 |
| Comp. Ex. 6 | 4.87 | 27.8 | 1.33 | 21.04 | 71.48 | 132 |
| Comp. Ex. 7 | 4.1 | 29.7 | 4.89 | 30.24 | 49.77 | 137 |
| Comp. Ex. 8 | 4.54 | 32.6 | 5.23 | 21.89 | 58.33 | 131 |
| Comp. Ex. 9 | 4.17 | 24.9 | 1.98 | 21.1 | 70.34 | 133 |
| Comp. Ex. 10 | 4.41 | 25.1 | 2.11 | 19.5 | 63.1 | 139 |
| Comp. Ex. 11 | 4.48 | 26.9 | 5.12 | 24.99 | 57.34 | 133 |
| Comp. Ex. 12 | 4.39 | 24.1 | 3.54 | 31.88 | 53.79 | 136 |
| Comp. Ex. 13 | 4.6 | 32.7 | 2.02 | 21.83 | 70.21 | 134 |
| Comp. Ex. 14 | 4.39 | 27.7 | 3.62 | 25.34 | 58.41 | 153 |
| Comp. Ex. 15 | 4.43 | 26.1 | 2.34 | 24.6 | 57.31 | 128 |

Two-component developers containing toners of Examples 1 to 12 and Comparative Examples 1 to 15 were prepared respectively by using a ferrite core carrier having a volume average particle size of 45 μm as a carrier and mixing them such that the coverage for the toners of Examples 1 to 12 and Comparative Examples 1 to 15 relative to the carrier were 60% by number in each of the cases by using a V-type mixer (trade name: V-5 manufactured by Tokuju Corporation) for 20 min.

By using the two-component developers containing the toners of Examples 1 to 12 and Comparative Examples 1 to 15 respectively, toner cleaning property, toner scattering, filming to the photoreceptor, transferability, and image reproducibility were evaluated by the following methods.

[Cleaning Property]

Under the circumstance at an atmospheric temperature of 20° C. and at a humidity of 50%, a character chart of an A4 size at a printed ratio of 6% was printed to 10,000 sheets of white paper and the cleaning property was evaluated by visually observing stains and white streaks in non-image area after printing 10,000 sheets.

Evaluation criteria are as described below.

Excellent: Very favorable. Image clarity is good and no white streaks are observed at all.

Good: Favorable. Image clarity is good, length of white streak is 2.0 mm or less and white streaks are generated in three or less places.

Not bad: No actual problems. Image clarity is at a level with no problem in actual use, length of white streaks is 2.0 mm or less, and white streaks are generated at five or less places.

Poor: No good. Image clarity gives problems in view of actual use, length of white streak is 2.0 or less and white streaks are generated in six or more places. Further, image clarity gives problems in view of actual use and white streaks of a length exceeding 2.0 mm are confirmed.

[Toner Scattering]

Two-component developers were filled respectively in a developing tank of a color copying machine (trade name: MX-2700, manufactured by Sharp Corp.), and the developing tank was rotated idly in a high temperature and high humidity circumstance at a temperature of 35° C. and at a relative humidity of 80% for 3 hr. It was judged more favorable with less toner scattering as the difference between the toner density in the two-component developer before idle rotation and the toner density in the two-component developer after idle rotation was smaller. A toner density difference was used as an index for the difference of the toner density before and after idle rotation, and the toner density difference was calculated according to the following expression (3):

$$\text{Toner density difference}(\%)=(\text{Toner density after idle rotation}/\text{Toner density before idle rotation})\times 100 \quad (3)$$

Evaluation criteria are as described below.

Excellent: Very favorable. Toner density difference is less than 0.15% by number.

Good: Favorable. Toner density difference is 0.15% by number or more and less than 0.25% by number.

Not bad: No problems in view of actual use. The toner density difference is 0.25% by number or more and less than 0.50% by number.

Poor: No good. Toner density difference is 0.5% by number or more.

[Filming to Photoreceptor]

A continuous actual printing test of forming an evaluation chart at an original density of 5% including an image solid area and a character area on 10,000 sheets of recording media for each single toner color was carried out for the toner deposition amount to a developing roller of 0.6 mm/cm$^2$ to 0.7 mg/cm$^2$ while controlling the toner deposition amount in a single color solid area of not-fixed toner images formed to a recording medium to 0.5 mg/cm$^2$. After the continuous actual printing test for 10,000 sheets, solid images corresponding to the actually used length in the longitudinal direction of the developing roller and the photoreceptor member was outputted, the obtained solid images were observed by naked eyes to judge occurrence for streaks or filming flaws to solid images and thereby evaluating filming to the photoreceptor. Evaluation criteria are as described below.

Good: Favorable. No streaks to solid images and no filming flaws to the surface of a photoreceptor.

Not bad: No problems in view of practical use. While streaks to solid images are not present but filming flaws are confirmed as the surface of the photoreceptor.

Poor: No good. Streaks to solid images and filming flaws at the surface of the photoreceptor are confirmed.

[Transferability]

Transferability was evaluated by means of a transfer efficiency. The transfer efficiency is a ratio of the amount of toner transferred from the surface of the photoreceptor drum to an intermediate transfer belt relative to the amount of the toner at the surface of the photoreceptor drum in primary transfer. The amount of the toner at the surface of the photoreceptor drum before transfer was obtained by sucking the toner using a charge amount measuring device (trade name: 210HS-2A, manufactured by TREK JAPAN K.K.) and measuring the amount of the sucked toner. Further, also the amount of the Loner transferred to the intermediate transfer belt was obtained in the same manner.

Transfer efficiency was calculated according to the following expression (4):

$$\text{Transfer efficiency}(\%)=(\text{Amount of toner transferred to intermediate transfer belt}/\text{Amount of toner transferred to the surface of photoreceptor drum before transfer})\times 100 \quad (4)$$

Evaluation criteria are as described below.

Excellent: Very favorable. Transfer efficiency is 98% or more.

Good: Favorable. Transfer efficiency is 95% or more and less than 98%.

Not bad: No problems in view of actual use. Transfer efficiency is 90% or more and less than 95% by number.

Poor: No good. Transfer efficiency is less than 90%.

[Image Reproducibility]

Two-component developers were filled to the copying machine respectively, an original formed with original images of thin lines having a line width just at 100 μm was copied on a recording medium under the conditions capable of copying half-tone images of 5 mm diameter and at an image density of 0.3 to an image density of 0.3 or more and 0.5 or less and the obtained copied images were used as a sample to be measured. The image density is an optimal reflection density measured by a reflection densitometer (trade name: RD-918 manufactured by Macbeth AG).

Thin lines formed to the sample to be measured were magnified by 100× by a particle analyzer (trade name: LUZEX 450, manufactured by Nireco Corporation), and the line width of a thin line formed to copied images was measured by an indicator based on monitor images in which thin lines magnified by 100× are shown.

Since thin lines formed to copied images include unevenness and the line width of the thin line is different depending on the measuring position, the line width was measured at a plurality of measuring positions to calculate an average value for the line width and the average value of the line width was defined as a line width of thin lines formed to the copied images. In this case, line widths of less than 100 μm due to "blurring" are not counted and the values for the line width of less than 100 μm were not used upon calculation for the average value of the line width. A value obtained by dividing the line width for a thin line formed on copy images by 100 μm which is the line width of original images and multiplying the obtained value by 100 times was defined as a value for the thin line reproducibility. Since the thin line reproducibility is better and the image reproducibility is excellent and the resolution is excellent as the value for the thin line reproducibility is closer to 100, this shows that the image reproducibility is good.

The image reproducibility was evaluated based on the following evaluation criteria.

Excellent: Very favorable. The value for thin line reproducibility is 100 or more and less than 105.

Good: Favorable. The value for thin line reproducibility is 105 or more and less than 110.

Not bad: No problems in view of practical use. The value for thin line reproducibility is 110 or more and less than 115.

Poor: No good. Value for thin line reproducibility is 115 or more.

[Comprehensive Evaluation]

Evaluation criteria for the comprehensive evaluation are as described below.

Excellent: Very favorable. Result of evaluation include neither "Not bad" or "Poor".

Good: Favorable. Result of evaluation does not includes "Poor" and includes "Not bad" by the number of 1.

Not bad: No problems in view of actual use. Result of evaluation does not include "Poor" and include "Not bad" by two or more.

Poor: No good. Result of evaluation includes at least one "Poor".

Table 2 shows the evaluation result of the toner and the result of comprehensive evaluation obtained in Examples 1 to 12 and Comparative Examples 1 to 15.

From the foregoings, it can be seen that the toner of Examples 1 to 12 are excellent in the cleaning property, the transferability, and the image reproducibility, can suppress toner scattering and filming to the photoreceptor and can form high quality images at high definition.

In the toners of Comparative Examples 1 to 13, since the particle size distribution is out of the range defined in the invention, toner scattering was generated.

In Comparative Example 14, since SF1 exceeds 140, additional toner particles were generated upon idle rotation of the developer and toner scattering was generated by such toner particles to lower the image reproducibility.

In Comparative Example 15, since SF1 was less than 130, the shape of the toner particle was excessively round, unnecessary toner at the surface of the photoreceptor cannot be removed efficiently by a cleaning blade, and stains was generated in the non-image area to worsen the cleaning property. Further, since the transferability is improved more as the value for SF1 is smaller, the image reproducibility is improved in this regard. However, since the unnecessary toner at the surface of photoreceptor could not be removed efficiently as described above, unnecessary toner remaining on the surface of the photoreceptor was also transferred in the transfer step to worsen the image reproducibility.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

TABLE 2

| | Cleaning property | | Toner scattering | | Filming to photoreceptor | Transferability | | Image reproducibility | | Comprehensive |
|---|---|---|---|---|---|---|---|---|---|---|
| | SF1 | Evaluation | Toner density difference (%) | Evaluation | Evaluation | Transfer efficiency (%) | Evaluation | Value for thin line reproducibility | Evaluation | evaluation |
| Ex. 1 | 135 | Good | 98.01% | Excellent | Good | 99% | Excellent | 102 | Excellent | Excellent |
| Ex. 2 | 133 | Not bad | 94.95% | Not bad | Good | 98% | Excellent | 104 | Excellent | Good |
| Ex. 3 | 133 | Not bad | 90.56% | Not bad | Not bad | 96% | Good | 109 | Good | Not bad |
| Ex. 4 | 137 | Good | 94.69% | Not bad | Good | 95% | Good | 107 | Good | Good |
| Ex. 5 | 133 | Not bad | 91.72% | Not bad | Good | 97% | Good | 108 | Good | Good |
| Ex. 6 | 130 | Not bad | 93.15% | Not bad | Good | 96% | Good | 107 | Good | Good |
| Ex. 7 | 135 | Good | 93.70% | Not bad | Good | 98% | Excellent | 106 | Good | Good |
| Ex. 8 | 132 | Not bad | 94.07% | Not bad | Good | 97% | Good | 105 | Good | Good |
| Ex. 9 | 133 | Not bad | 95.57% | Good | Good | 98% | Excellent | 108 | Good | Excellent |
| Ex. 10 | 139 | Excellent | 94.50% | Not bad | Good | 99% | Excellent | 109 | Good | Good |
| Ex. 11 | 136 | Good | 93.10% | Not bad | Good | 97% | Good | 107 | Good | Good |
| Ex. 12 | 135 | Good | 92.32% | Not bad | Not bad | 96% | Good | 112 | Not bad | Excellent |
| Comp. Ex. 1 | 135 | Poor | 89.92% | Poor | Poor | 91% | Not bad | 119 | Poor | Poor |
| Comp. Ex. 2 | 137 | Good | 89.26% | Poor | Not bad | 94% | Not bad | 115 | Poor | Poor |
| Comp. Ex. 3 | 133 | Not bad | 87.88% | Poor | Poor | 90% | Not bad | 114 | Not bad | Poor |
| Comp. Ex. 4 | 130 | Not bad | 89.05% | Poor | Not bad | 96% | Good | 113 | Not bad | Poor |
| Comp. Ex. 5 | 135 | Good | 89.76% | Poor | Not bad | 92% | Not bad | 111 | Not bad | Poor |
| Comp. Ex. 6 | 132 | Not bad | 89.61% | Poor | Not bad | 93% | Not bad | 112 | Not bad | Poor |
| Comp. Ex. 7 | 137 | Not bad | 87.15% | Poor | Poor | 92% | Not bad | 110 | Not bad | Poor |
| Comp. Ex. 8 | 131 | Not bad | 89.21% | Poor | Not bad | 91% | Not bad | 113 | Not bad | Poor |
| Comp. Ex. 9 | 133 | Not bad | 88.71% | Poor | Poor | 88% | Poor | 116 | Poor | Poor |
| Comp. Ex. 10 | 139 | Excellent | 86.81% | Poor | Not bad | 90% | Not bad | 113 | Not bad | Poor |
| Comp. Ex. 11 | 133 | Not bad | 89.84% | Poor | Poor | 89% | Poor | 119 | Poor | Poor |
| Comp. Ex. 12 | 136 | Good | 89.40% | Poor | Not bad | 95% | Good | 114 | Not bad | Poor |
| Comp. Ex. 13 | 134 | Not bad | 87.90% | Poor | Not bad | 89% | Not bad | 110 | Not bad | Poor |
| Comp. Ex. 14 | 153 | Excellent | 86.86% | Poor | Not bad | 91% | Not bad | 117 | Poor | Poor |
| Comp. Ex. 15 | 128 | Poor | 93.78% | Not bad | Not bad | 99% | Excellent | 115 | Poor | Poor |

What is claimed is:

1. A toner comprising a plurality of toner particles containing a binder resin and a colorant, wherein, according to measurement by a flow particle image analyzer, (a) a content of small size particles which are toner particles having a circle-equivalent diameter of 0.5 μm or more and 2.0 μm or less is 5% by number or less based on the entire toner particles, (b) a content of medium size particles which are toner particles having a circle-equivalent diameter larger than 2.0 μm and 4.0 μm or less is 20% by number or more and 30% by number or less in term of the number based on the total toner particles, (c) a content of large size particles which are toner particles having a circle-equivalent diameter above 4.0 μm and 6.0 μm or less is 50% by number or more and 70% by number or less based on the entire toner particles, and a shape factor SF1 of the toner particles is 130 or more and 140 or less.

2. The toner of claim 1, wherein a ratio A/B for a number A of the medium size particles and a number B of the large size particles satisfies the following expression (1)

$$0.30 \leqq A/B \leqq 0.60 \quad (1).$$

3. The toner of claim 1, wherein a ratio r/R between a peak value r for the number-based particle size of the medium size particles which is a particle size of toner particles at a highest content among the medium size particles, and a peak value R for the number-based particle size of the large size particles which is a particle size of the toner particles at a highest content among the large size particles satisfies the following expression (2):

$$0.50 < r/R < 0.70 \quad (2).$$

4. A method of manufacturing the toner of claim 1, comprising:

mixing a first group of toner particles having a number average particle size of 2.0 or more and 4.0 μm or less and a second group of toner particles having a number average particle size of 4.0 μm or more and 6.0 μm or less.

5. The method of claim 4, wherein a coefficient of variation of the first group of toner particles is 16 or more and 25 or less.

6. The method of claim 4, wherein a coefficient of variation of the second group of toner particles is 19 or more and 30 or less.

7. A developer comprising the toner of claim 1.

8. A two-component developer comprising the toner of claim 1 and a carrier.

9. A developing device for developing a latent image formed on an image bearing member by using the developer of claim 7 and thereby forming a toner image.

10. A developing device for developing a latent image formed on an image bearing member by using the two-component developer of claim 8 and thereby forming a toner image.

11. An image forming apparatus comprising:

an image bearing member on which a latent image is formed;

a latent image forming section for forming a latent image on the image bearing member; and the developing device of claim 9.

12. An image forming apparatus comprising:

an image bearing member on which a latent image is formed;

a latent image forming section for forming a latent image on the image bearing member; and the developing device of claim 10.

* * * * *